US010774576B1

(12) United States Patent
Vonnahme et al.

(10) Patent No.: US 10,774,576 B1
(45) Date of Patent: Sep. 15, 2020

(54) GATE ASSEMBLY

(71) Applicant: Ameristar Perimeter Security USA Inc., Tulsa, OK (US)

(72) Inventors: Gary W. Vonnahme, Broken Arrow, OK (US); Benton P. Flusche, Muskogee, OK (US); Nathan T. Haney, Owasso, OK (US)

(73) Assignee: Ameristar Perimeter Security USA Inc., Tulsa, OK (US)

( * ) Notice: Subject to any disclaimer, the term of this patent is extended or adjusted under 35 U.S.C. 154(b) by 0 days.

(21) Appl. No.: 16/138,135

(22) Filed: Sep. 21, 2018

Related U.S. Application Data

(60) Provisional application No. 62/574,768, filed on Oct. 20, 2017.

(51) Int. Cl.
*E06B 1/60* (2006.01)
*E06B 11/02* (2006.01)
(Continued)

(52) U.S. Cl.
CPC ..... *E06B 1/6092* (2013.01); *E06B 11/021* (2013.01); *E04H 17/1417* (2013.01); *E04H 17/18* (2013.01); *E04H 17/24* (2013.01)

(58) Field of Classification Search
CPC ..... E06B 1/6092; E06B 11/021; E06B 11/00; E06B 11/02; E04H 17/1417; E04H 17/165; E04H 17/24; E04H 17/18
See application file for complete search history.

(56) References Cited

U.S. PATENT DOCUMENTS 1,180,597 A * 4/1916 Miller ..... E04H 17/18 256/25
1,546,300 A * 7/1925 Mann ..... E04H 17/06 256/1
(Continued)

FOREIGN PATENT DOCUMENTS

DE 29722616 U1 * 2/1998 ..... E04B 2/827
DE 19842296 A1 * 4/2000 ..... E04H 17/163
(Continued)

OTHER PUBLICATIONS

Gate systems like those shown in the attached photographs were in public use in the United States, and on sale in the United States, for more than one year prior to Oct. 20, 2017.
(Continued)

*Primary Examiner* — Christine T Cajilig
(74) *Attorney, Agent, or Firm* — Gary Peterson

(57) ABSTRACT

A gate assembly is formed from a gate attached by hinges to a jamb. A pair of L-shaped brackets are attached to the outer sides of the jamb. The brackets are in turn attached to a pair of gate posts in a barrier. Bolt holes formed in the header section of the jamb receive removable eye bolts that may be used as hoisting points as the jamb is being positioned within a barrier. To maintain the shape of the jamb during such positioning, a removable sill section is included in the base of the jamb. The first upright section of the jamb defines an unobstructed internal channel bounded by input and output portals. A cable may pass though the channel and into the gate by way of the output portal. Window openings in the gate may be fitted with removable window panels containing pickets and infill material. Dual gates may be positioned within an enlarged jamb, and a removable mullion post positioned between the gates and supported by the jamb.

13 Claims, 36 Drawing Sheets

(51) Int. Cl.

| | |
|---|---|
| ***E04H 17/18*** | (2006.01) |
| ***E04H 17/24*** | (2006.01) |
| ***E04H 17/14*** | (2006.01) |

(56) References Cited

U.S. PATENT DOCUMENTS

| | | | | |
|---|---|---|---|---|
| 3,428,108 | A | 2/1969 | Singer | |
| 3,524,627 | A | 8/1970 | Boyanton | |
| 4,174,096 | A | 11/1979 | Campbell | |
| 4,467,585 | A * | 8/1984 | Busby | E04B 1/35 52/122.1 |
| 4,856,575 | A * | 8/1989 | Wells | A01K 1/035 160/353 |
| 5,078,367 | A | 1/1992 | Simpson et al. | |
| 5,581,944 | A * | 12/1996 | Kornbrekke | E05D 11/0081 49/28 |
| 6,481,165 | B1 * | 11/2002 | Romary | E04B 1/34336 52/122.1 |
| 6,517,280 | B2 | 2/2003 | Carter | |
| 6,672,569 | B2 | 1/2004 | Campbell | |
| 7,686,283 | B2 | 3/2010 | Marchio | |
| 8,438,995 | B1 | 5/2013 | Donahue et al. | |
| 8,783,661 | B1 | 7/2014 | Payne | |
| 10,273,712 | B1 * | 4/2019 | Arnold, Jr. | E06B 1/36 |
| 10,426,056 | B1 * | 9/2019 | McNair | E06B 11/021 |
| 2006/0150546 | A1 | 7/2006 | Campbell | |
| 2006/0231821 | A1 | 10/2006 | Campbell | |
| 2008/0173856 | A1 * | 7/2008 | Payne | E04H 17/161 256/47 |
| 2008/0237559 | A1 * | 10/2008 | Marchio | E06B 11/02 256/32 |
| 2009/0273322 | A1 * | 11/2009 | Riley | H02K 7/1853 322/3 |
| 2009/0321701 | A1 * | 12/2009 | Payne | E04H 3/08 256/57 |
| 2010/0264389 | A1 | 10/2010 | Alberts | |
| 2011/0252845 | A1 * | 10/2011 | Webb | H02N 2/183 70/101 |
| 2012/0256148 | A1 | 10/2012 | Sirotin et al. | |
| 2014/0191175 | A1 * | 7/2014 | Bertato | E04H 17/16 256/31 |

FOREIGN PATENT DOCUMENTS

| | | | | |
|---|---|---|---|---|
| DE | 1998142296 | A1 | 4/2000 | |
| DE | 19920488 | A1 * | 11/2000 | E04B 1/58 |
| DE | 102009006011 | A1 * | 7/2010 | E04H 17/165 |
| DE | 102015213523 | A1 * | 1/2017 | E06B 11/02 |
| DE | 102015213523 | A1 | 1/2017 | |

OTHER PUBLICATIONS

Sargent Manufacturing Company, installation Instructions for L980 Mullion, 2009, USA.

* cited by examiner

GATE ASSEMBLY

SUMMARY OF THE INVENTION

A gate assembly is formed from a jamb and a swinging gate. The jamb has a plurality of sections that cooperate to define boundaries of a gateway. These sections include an elongate first upright section and a parallel elongate second upright section. A header section interconnects the first and second upright sections. The first upright section includes an input portal, an output portal and an unobstructed internal channel interconnecting the input and output portals. The gate is pivotally attached to the first upright section and is positionable within the gateway.

Another gate assembly is formed from a jamb and a swinging gate. The jamb has a plurality of sections that cooperate to define boundaries of a gateway. These sections include an elongate first upright section and a parallel elongate second upright section. A header section interconnects the first and second upright sections. The first upright section supports a projecting leg that extends away from the gateway. The second upright section extends parallel to the first upright section and also supports a projecting leg that extends away from the gateway. The gate is pivotally attached to the first upright section and is positionable within the gateway.

Another gate assembly is formed from a jamb and a swinging gate. The jamb has a plurality of sections that cooperate to define boundaries of a gateway. These sections include an elongate first upright section and a parallel elongate second upright section. A header section interconnects the first and second upright sections. A removable sill section also interconnects the first and second upright sections and forms another boundary of the gateway. The gate is pivotally attached to the first upright section and is positionable within the gateway.

Another gate assembly is formed from a jamb and a swinging gate. The jamb has a plurality of sections that cooperate to define boundaries of a gateway. These sections include an elongate first upright section and a parallel elongate second upright section. A header section interconnects the first and second upright sections. The header section has a plurality of bolt openings formed in a portion thereof situated opposite the gateway. The gate is pivotally attached to the first upright section and is positionable within the gateway.

Another gate assembly is formed from a jamb and a swinging gate. The jamb has a plurality of sections that cooperate to define boundaries of a gateway. These sections include an elongate first upright section and a parallel elongate second upright section. A header section interconnects the first and second upright sections. The gate is pivotally attached to the first upright section and is positionable within the gateway. The gate has opposed sides and at least one window opening that interconnects the sides. At least one modular window panel is removably installed within a respective window opening.

A gate assembly is formed from a jamb and a swinging gate. The jamb has a plurality of sections that cooperate to define boundaries of a gateway. These sections include an elongate first upright section and a parallel elongate second upright section. A header section interconnects the first and second upright sections. The gate is pivotally attached to the first upright section and is positionable within the gateway.

A mechanical closer is supported by the gate, and includes an arm. A closer attachment bracket is supported by the jamb and engages the arm of the closer. The closer attachment bracket includes a base section and an upright section. The base section is penetrated by a plurality of fastener openings. The upright section adjoins the base section, and extends in transverse relationship thereto.

BRIEF DESCRIPTION OF THE DRAWINGS

FIG. 6 is an enlarged cross-sectional view of the upper portion of the jamb shown in FIG. 5.

FIG. 11 is a side elevation view of the sill section shown in FIG. 9, taken along line 11-11.

FIG. 18 is a side elevation view of the closer attachment bracket shown in FIG. 17, taken along line 18-18.

FIG. 19 is a top plan view of the closer attachment bracket shown in FIG. 17, taken along line 19-19.

FIG. 28 is a top plan view of the gate assembly shown in FIG. 25, taken along line 28-28. The gate is in a closed position.

FIG. 29 is a top plan view of the gate assembly shown in FIG. 25, similar to FIG. 28, but with the gate in an open position.

FIG. 33 is a top plan view of the gate assembly shown in FIG. 32, taken along line 33-33.

FIG. 36 is a rear elevation view of the gate assembly shown in FIG. 35.

FIG. 38 is a perspective view of a sill section.

DETAILED DESCRIPTION

Figure 1:
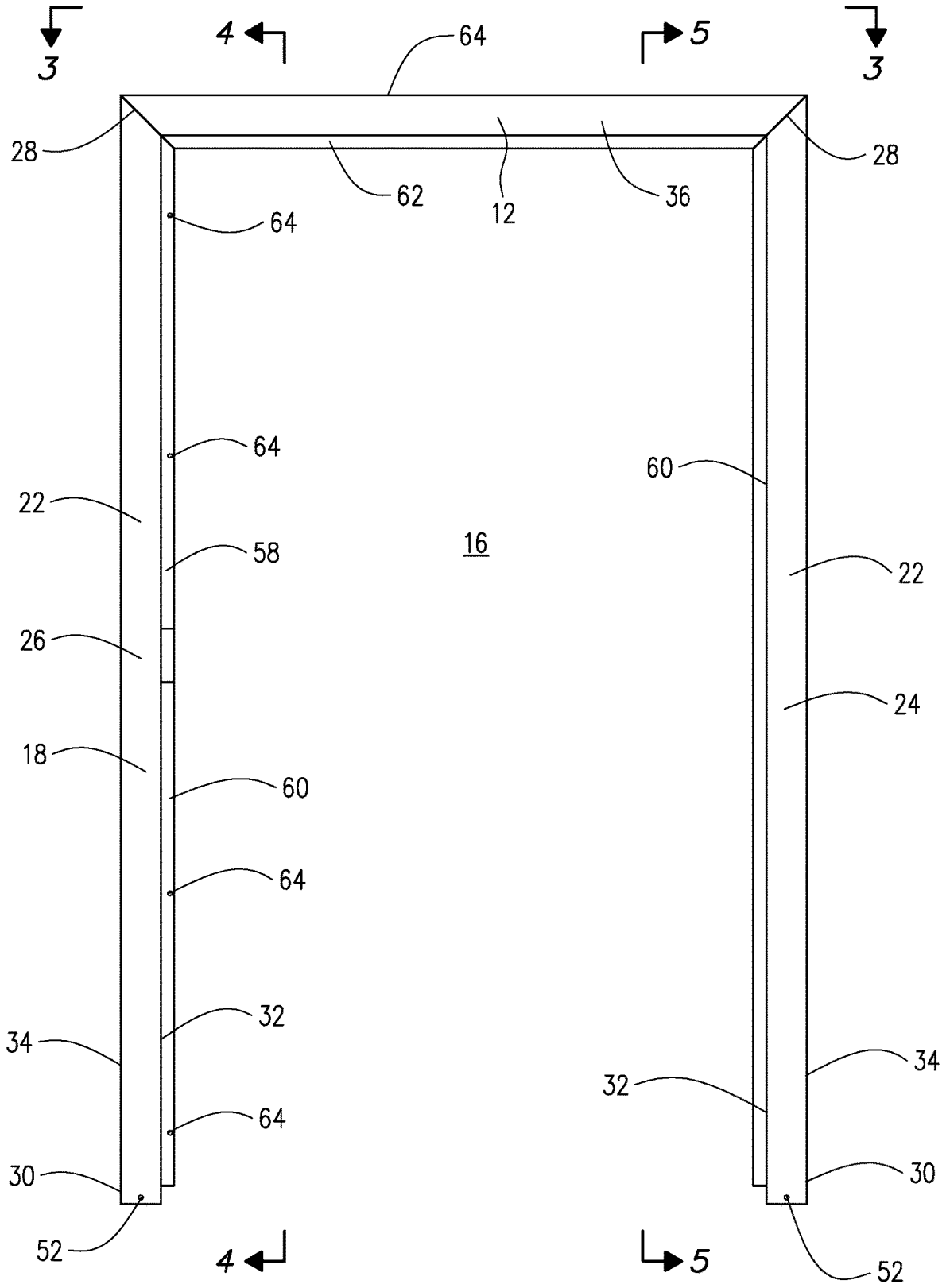
FIG. 1 is a front elevation view of a jamb.

A gate assembly 10, shown in FIGS. 25-29, is formed from a jamb 12 and at least one swinging gate 14. The jamb 12, shown in FIGS. 1-11, is a flat structure of rectangular shape having a front side 18 and a rear side 20.

The jamb 12 is formed from a plurality of sections that cooperate to define boundaries of a gateway 16. These sections should be formed from a strong and durable material, such as steel or aluminum. Suitable steels include pre-galvanized steel and stainless steel.

The sections of the jamb 12 include a pair of elongate upright jamb sections 22, namely first upright section 24 and second upright section 26. The upright jamb sections 22 extend parallel to one another, and preferably are of identical size, shape and construction. Each upright jamb section 22 has an upper end 28, an opposed lower end 30, an inner side 32 and an opposed outer side 34. The upper ends 28 of the upright jamb sections 22 are joined by an orthogonal header section 36, which preferably has the same cross-sectional size and shape as the upright jamb sections 22. Preferably each of the sections 22 and 36 is tubular along its entire length.

Figure 2:
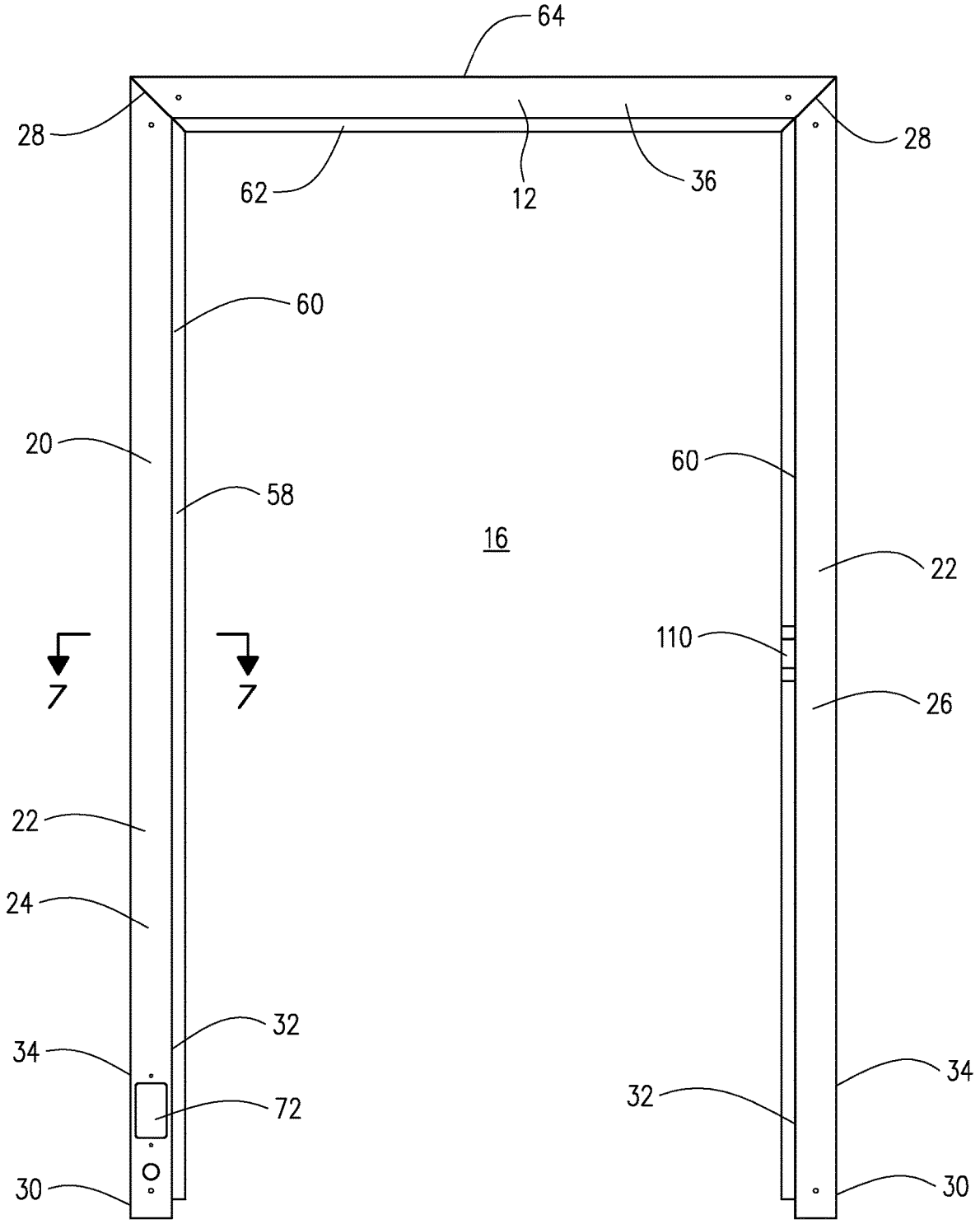
FIG. 2 is a rear elevation view of the jamb shown in FIG. 1.

The sections 22 and 36 are joined by welding or fasteners. Preferably, the sections 22 and 36 are joined permanently. As shown in FIGS. 1 and 2, mitered joints are preferably formed where the header section 36 and first upright section 24 are joined, and where the header section 36 and second upright section 26 are joined.

In one embodiment, each of the sections 22 and 36 is 12 gauge galvanized steel and formed from square tubing having a 3-inch side. The upright jamb sections 22 each have an inside length of 80.375 inches and an outside length of 83.375 inches. The header section 36 has an inside length of 45.5 inches and an outside length of 51.5 inches.

Preferably, the jamb 12 further comprises a removable sill section 38, best shown in FIGS. 8-11. The sill section 38 interconnects the lower ends 30 of the upright jamb sections 22 and forms another boundary of the gateway 16. The sill section 38 is preferably an elongate L-shaped structure formed from an upper leg 40 and an orthogonal lower leg 42. The upper leg 40 has a rectangular shape. The lower leg 42 is generally rectangular, but has a pair of identical rectangular upper notches 44 removed from its upper corners, and a pair of identical rectangular lower notches 46 removed from its lower corners. The notches 44 and 46 bound a projecting ear 48 formed on each end of the lower leg 42. A fastener opening 50 is formed in each ear 48.

Figure 25:
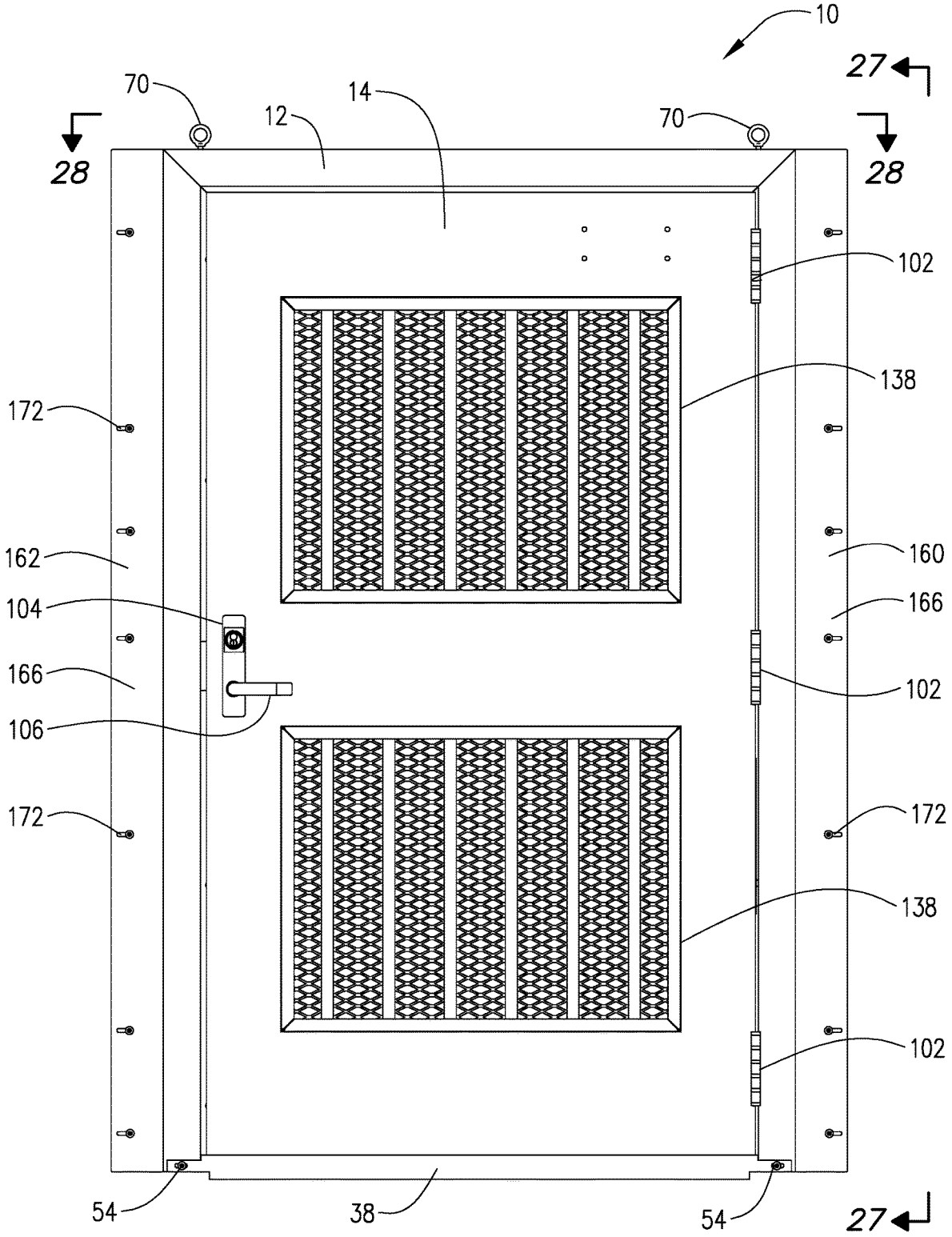
FIG. 25 is a front elevation view of a gate assembly.
Figure 30:
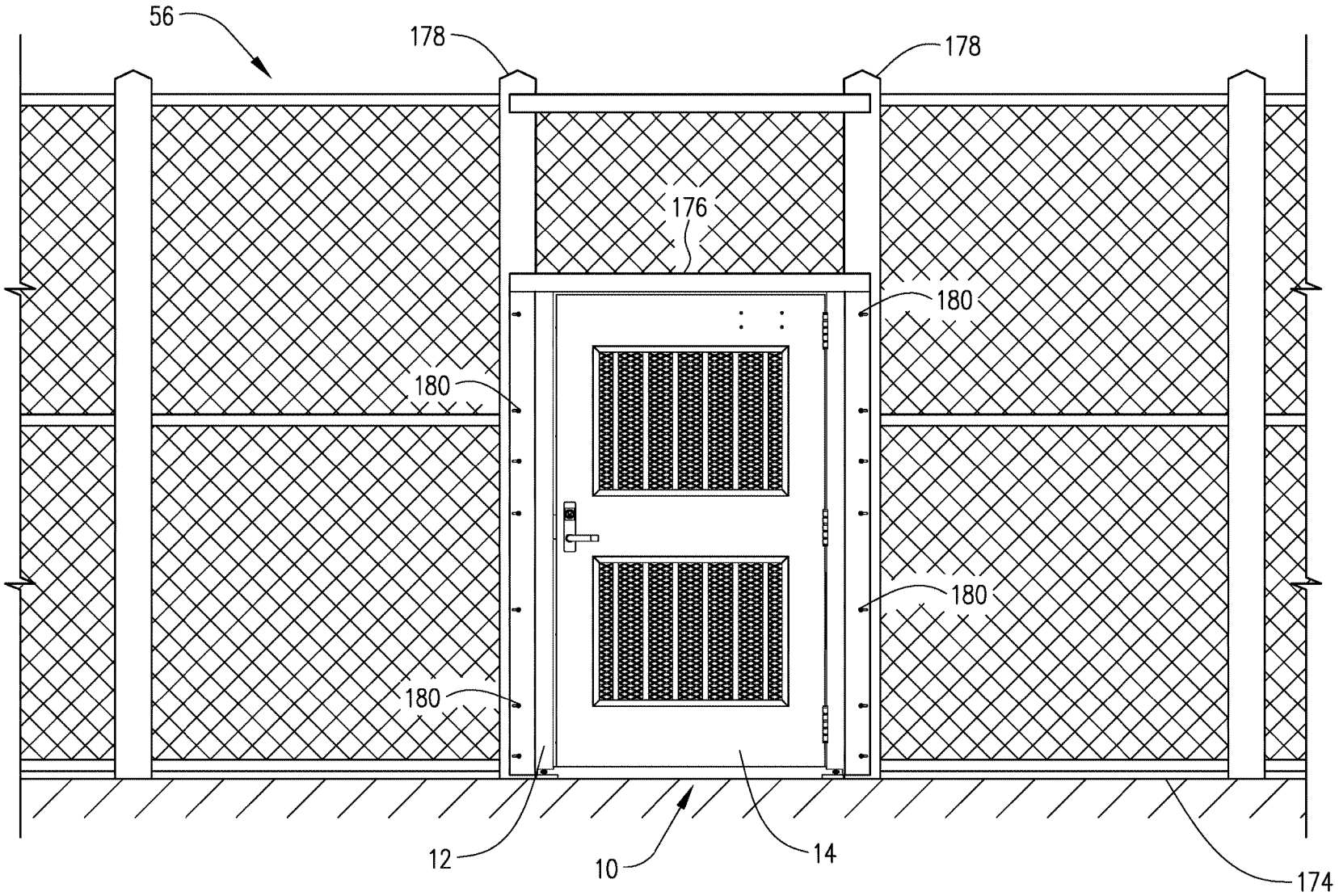
FIG. 30 is a front elevation view of a barrier incorporating the gate assembly of FIG. 25.

Each fastener opening 50 may be aligned with a corresponding fastener opening 52 formed on the front side 18 of each of the upright jamb sections 22, near the lower end 30. As shown in FIG. 25, fasteners 54, such as bolts, may be inserted through the aligned openings to removably join each end of the sill section 38 to a respective upright jamb section 22. The sill section 38 assists in maintaining the flat and rectangular shape of the jamb 12 while the gate assembly 10 is being incorporated into a barrier 56, as shown in FIG. 30. Once incorporation is complete, the fasteners may be removed, together with the sill section 38. Because the sill section 38 is removable, there is no need to bury it.

In one embodiment, the sill section 38 is formed from A36 sheet steel having a thickness of 0.25 inches. The upper leg 40 is of rectangular shape with a major side dimension of 45.38 inches and a minor side dimension of 2.00 inches. The lower leg 42 has a maximum length of 50.88 inches and a maximum width of 2.00 inches. The upper notches 44 are of identical rectangular shape with a major side dimension of 2.75 inches and a minor side dimension of 0.44 inches. The lower notches 46 are of identical rectangular shape with a major side dimension of 3.44 inches and a minor side dimension of 0.63 inches.

The jamb 12 preferably further comprises a stop 58 that prevents the gate 14 from overswinging as it reaches its closed position. Instead, upon closing, the gate 14 seats against the stop 58. The stop 58 is formed from a pair of parallel and upright side sections 60 of identical shape and size. The side sections 60 are joined at their upper ends by an orthogonal upper section 62, preferably having the same cross-sectional size and shape as the side sections 60. Preferably each of the sections 60 and 62 is tubular along its entire length. The sections 60 and 62 form a flat and C-shaped structure that fits within the gateway 16 formed by the jamb 12. Adjacent sections of the stop 58 are joined by welding or fasteners.

Figure 7:
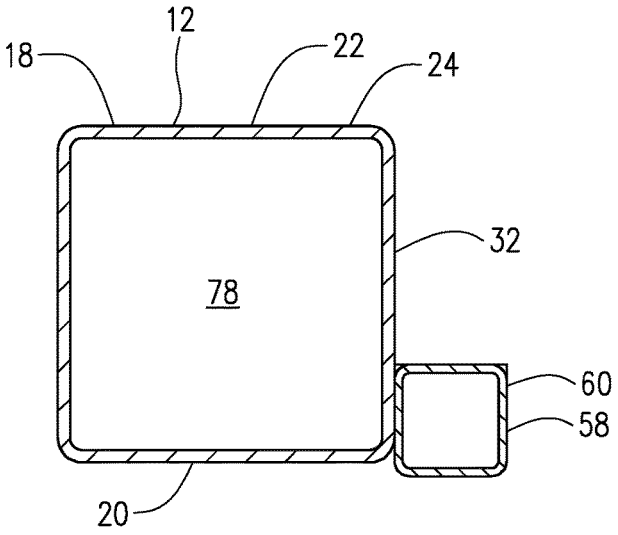
FIG. 7 is a cross-sectional view of the first upright section of the jamb shown in FIG. 2, taken along line 7-7.

As shown in FIGS. 1 and 2, mitered joints are preferably formed where the upper section 62 joins each side section 60. Each of the side sections 60 is also joined, by welding or fasteners, to a corresponding one of the upright jamb sections 22. The upper section 62 is joined to the header section 36, by welding or fasteners. As best shown in FIGS. 6 and 7, each section of the stop 58 is situated nearest the rear side 20 of the jamb 12, and projects slightly outside the footprint of the jamb 12. In one embodiment each of the sections 60 and 62 is 14 gauge sheet steel and formed from square tubing having a 1-inch side. Each section of the stop 58 projects 0.125 inches outside the footprint of the jamb 12.

Optionally, a plurality of vertically spaced fastener openings 64 may be formed in the side section 60 of the stop 58 that engages the gate 14, as shown in FIG. 1. Silencer pads (not shown) may be attached to the stop 58 at the openings 64, in order to cushion the gate 14 and reduce noise at closure. Four such fastener openings 64 are provided in the embodiment shown in the Figures.

Figure 3:
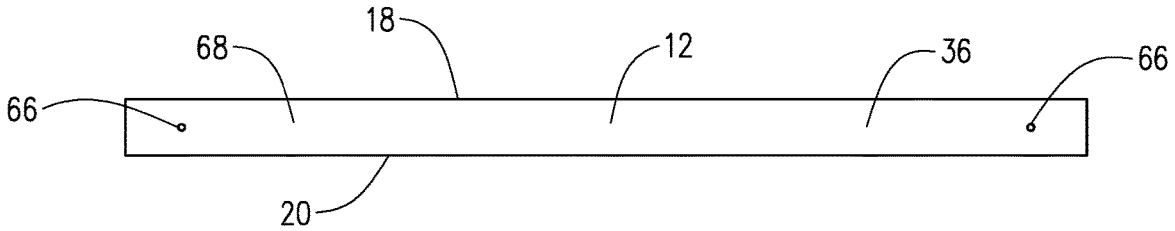
FIG. 3 is a top plan view of the jamb shown in FIG. 1, taken along line 3-3.

As shown in FIG. 3, a plurality of longitudinally spaced bolt holes 66 are formed in the upper surface 68 of the header section 36. The upper surface 68 is situated on the opposite side of the header section 36 from the gateway 16. In the embodiment shown in the Figures, two such bolt holes 66 are formed. A plurality of eye bolts 70, shown in FIGS. 25-29, are installable in respective ones of the bolt holes 66. The number of eye bolts 70 preferably equals the number of bolt holes 66. In one embodiment, the eye bolts 70 are zinc-coated, and have a ⅜-16 thread size and a 1.25 inch shank length.

When installed within the bolt holes 66 of the jamb 12, the eye bolts 70 may be attached to hoisting equipment that is used to position the gate assembly 10 during its installation within a barrier 56. Once installation is complete, the eye bolts 70 may be removed from the bolt holes 66. Optionally, the removed eye bolts 70 may be replaced in the bolt holes 66 by some other filler or fastener, such as a trilobular fastener (not shown).

Figure 26:
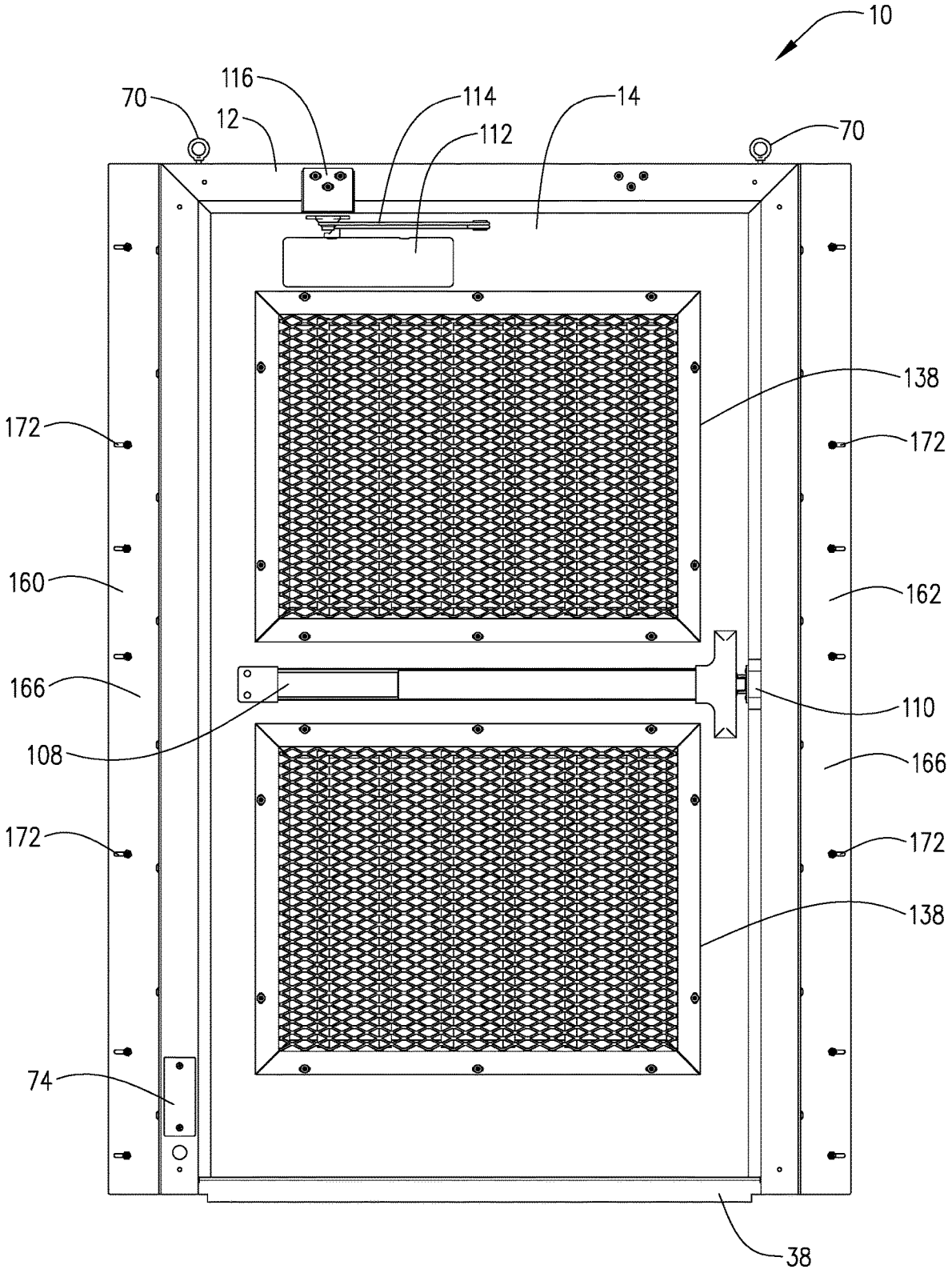
FIG. 26 is a rear elevation view of the gate assembly shown in FIG. 25.

As shown in FIG. 2, an input portal 72 is formed in the first upright section 24, preferably in a portion thereof that does not face the gateway 16. In the embodiment shown in the Figures, the input portal 72 is formed in the rear side 20 of the jamb 12, near its lower end 30. The input portal 72 should be sized to permit passage of one or more electrical or communication conduits, such as a cable, and may be provided with a removable cover 74, as shown in FIG. 26.

Figure 5:
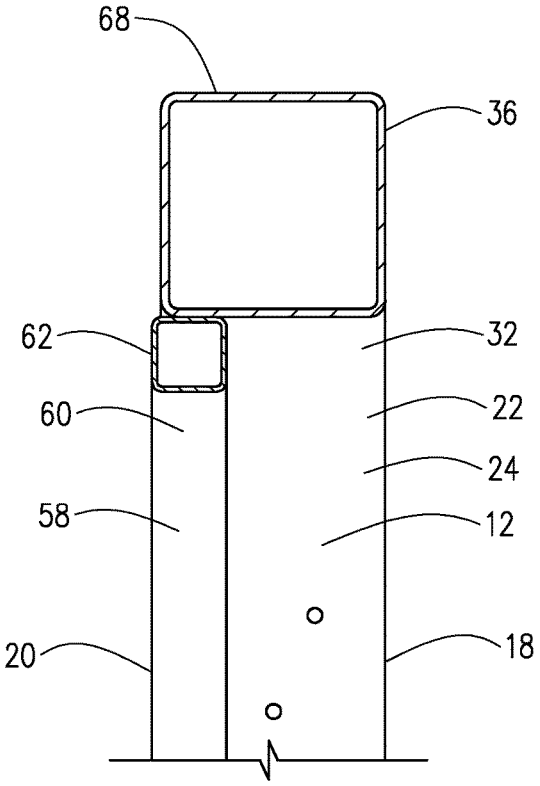
FIG. 5 is a cross-sectional view of the jamb shown in FIG. 1, taken along line 5-5.

Also formed in the first upright section 24 is an output portal 76, shown in FIG. 5. The output portal 76 is likewise sized to permit passage of one or more electrical or communication conduits. Preferably, the output portal 76 is formed in the inner side 32, which faces the gateway 16. As shown in FIG. 7, the tubular first upright section 24 provides an unobstructed internal channel 78 that interconnects the input portal 72 and output portal 76. An electrical or communication conduit may conveniently be extended into input portal 72, along the channel 78, through output portal 76 and into the gate 14, where it may service an electronic lock or other powered appliance within the gate 14.

Figure 12:
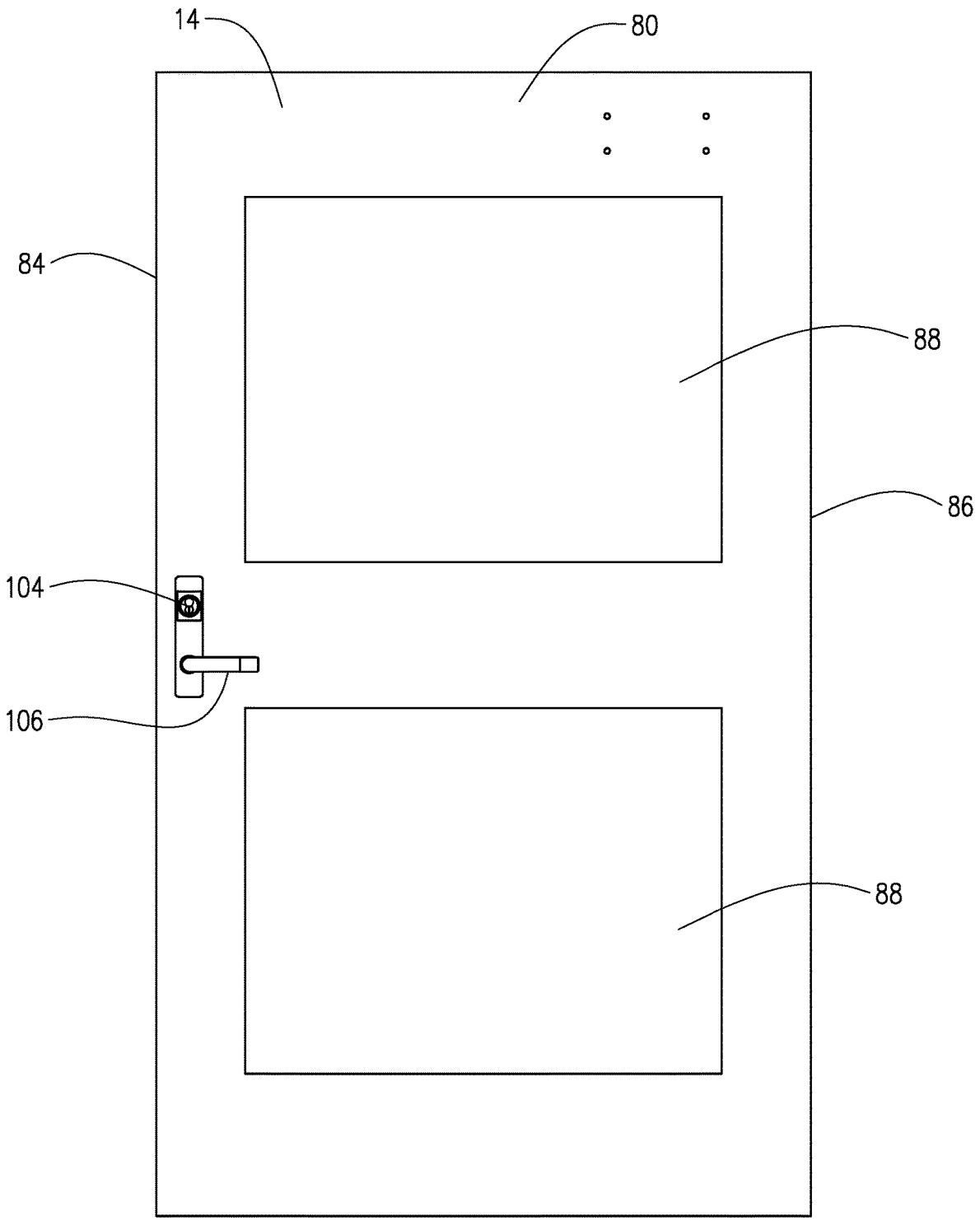
FIG. 12 is a front elevation view of a gate.
Figure 13:
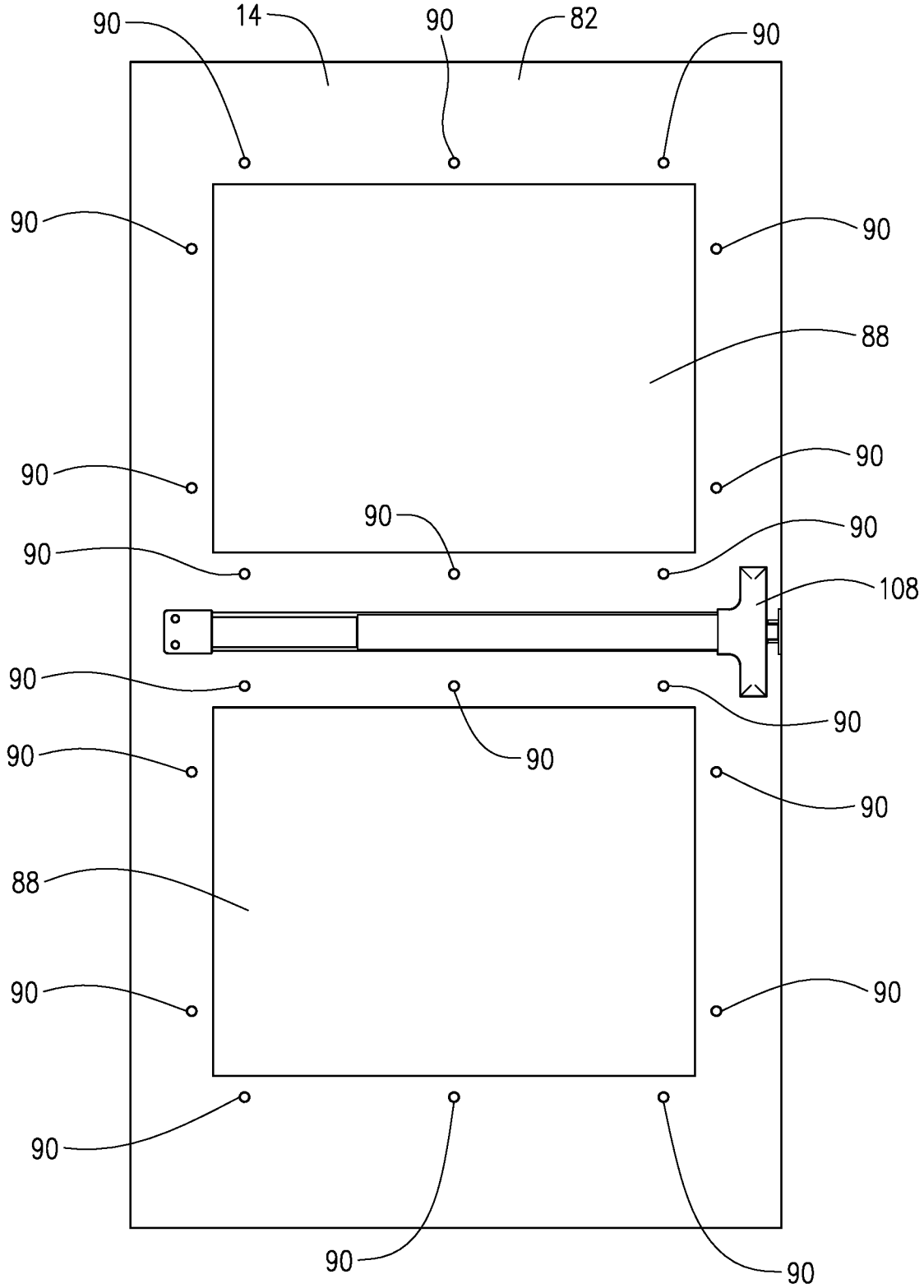
FIG. 13 is a rear elevation view of the gate shown in FIG. 12. The closer is omitted.

The gate 14, shown in detail in FIGS. 12 and 13, is a rectangularly-shaped structure formed from a strong and durable material, such as steel. In one embodiment, the gate 14 is formed from 14 gauge galvanized steel and has a thickness of 1.75 inches. The gate 14 has a front side 80 and a parallel and opposed rear side 82. The sides 80 and 82 are interconnected by an upright latch surface 84 and a parallel and opposed hinge surface 86. The gate 14 is sized to be closely but clearingly received within the gateway 16.

As shown in FIGS. 12 and 13, at least one, and preferably a plurality of window openings 88 are formed in the gate 14. Each window opening 88 interconnects the sides 80 and 82. A plurality of fastener openings 90, shown in FIG. 13, are formed in the rear side 82 of the gate 14. A plural number of the fastener openings 90 surround each of the window openings 88. In the embodiment of the gate 14 shown in the Figures, two such window openings 88 are formed. Each window opening 88 is surrounded by ten fastener openings 90.

Figure 14:
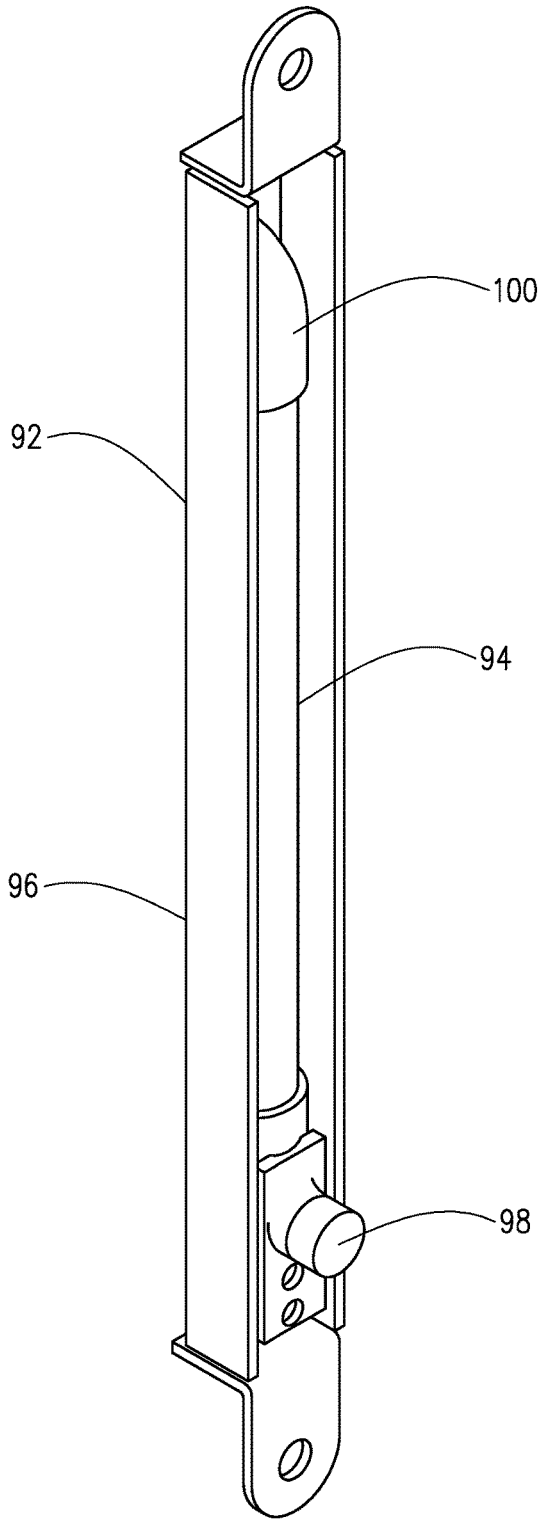
FIG. 14 is a perspective view of a power transfer lead cover.
Figure 15:
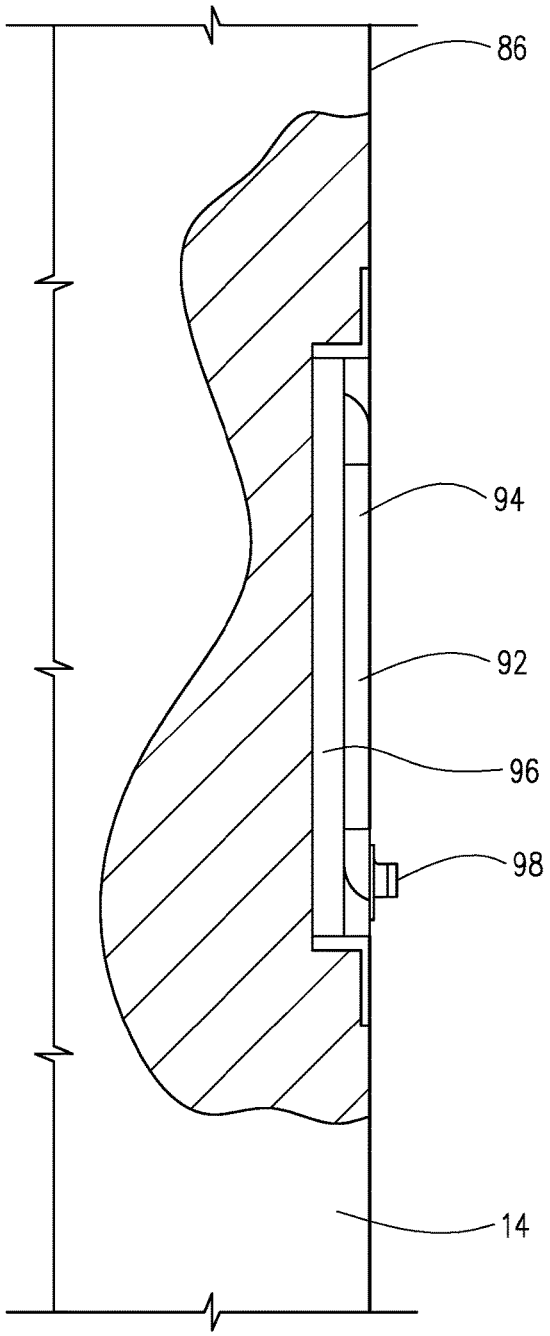
FIG. 15 is an enlarged and partially cut away view of a portion of the gate of FIG. 13, showing the installed power transfer lead cover.
Figure 16:
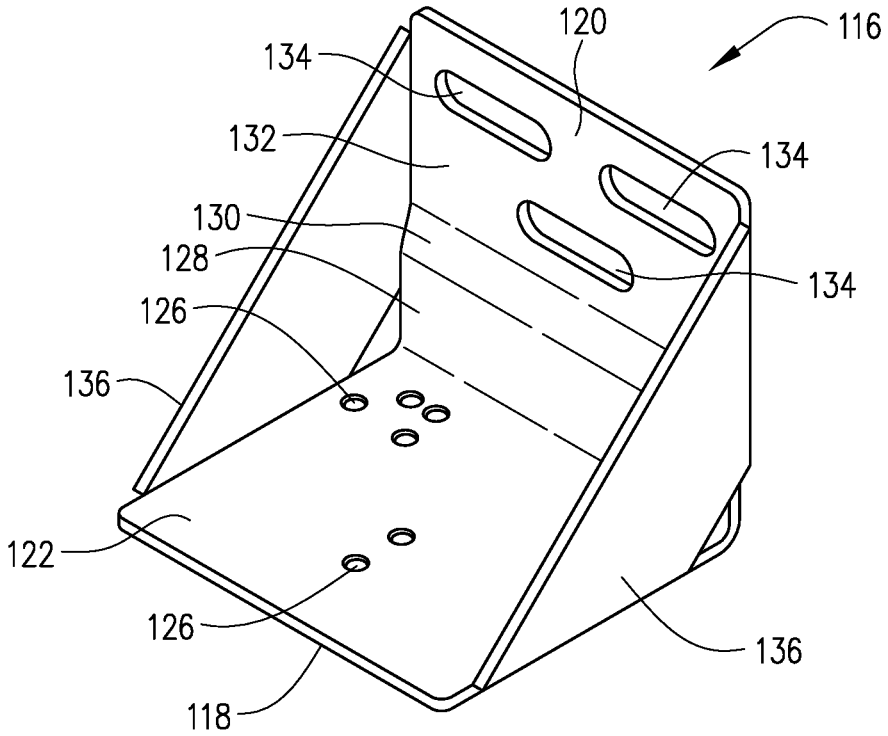
FIG. 16 is a perspective view of a closer attachment bracket.
Figure 17:
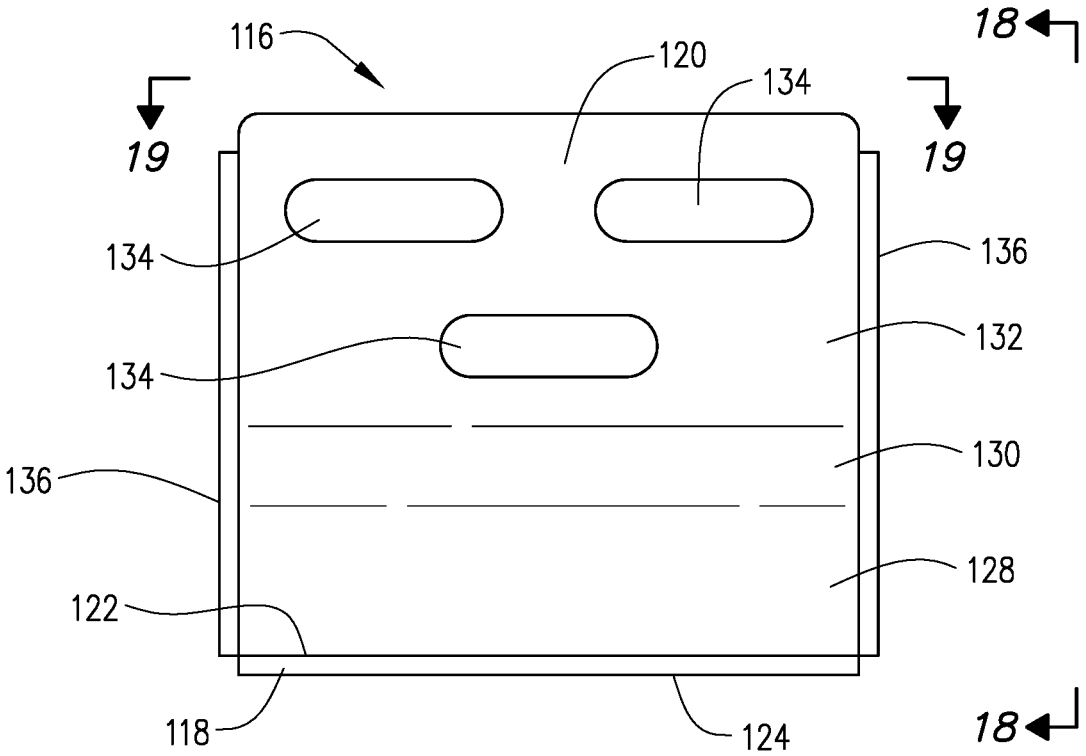
FIG. 17 is a front elevation view of the closer attachment bracket shown in FIG. 16.
Figure 1A:
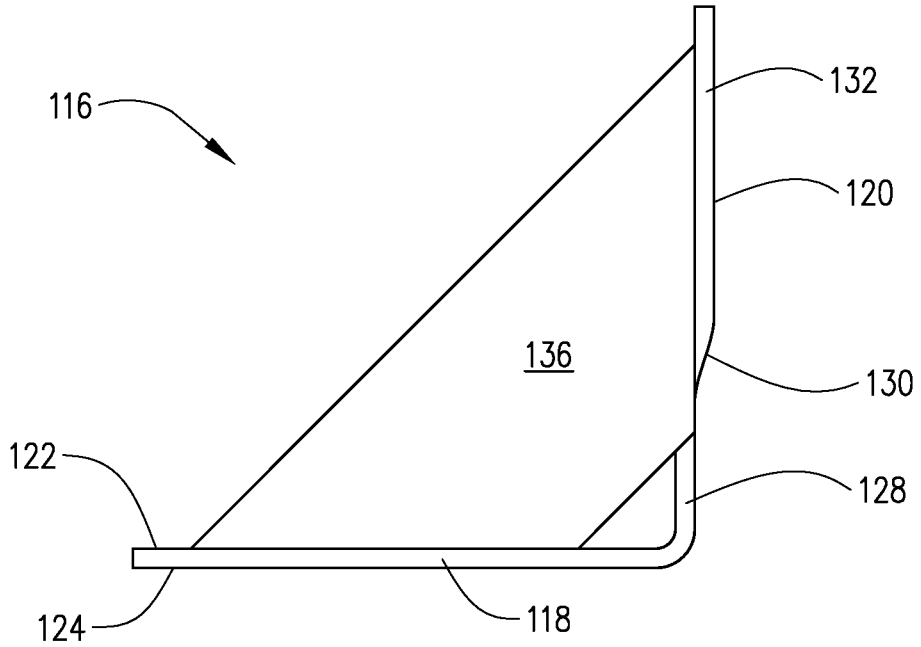
Figure 1B:
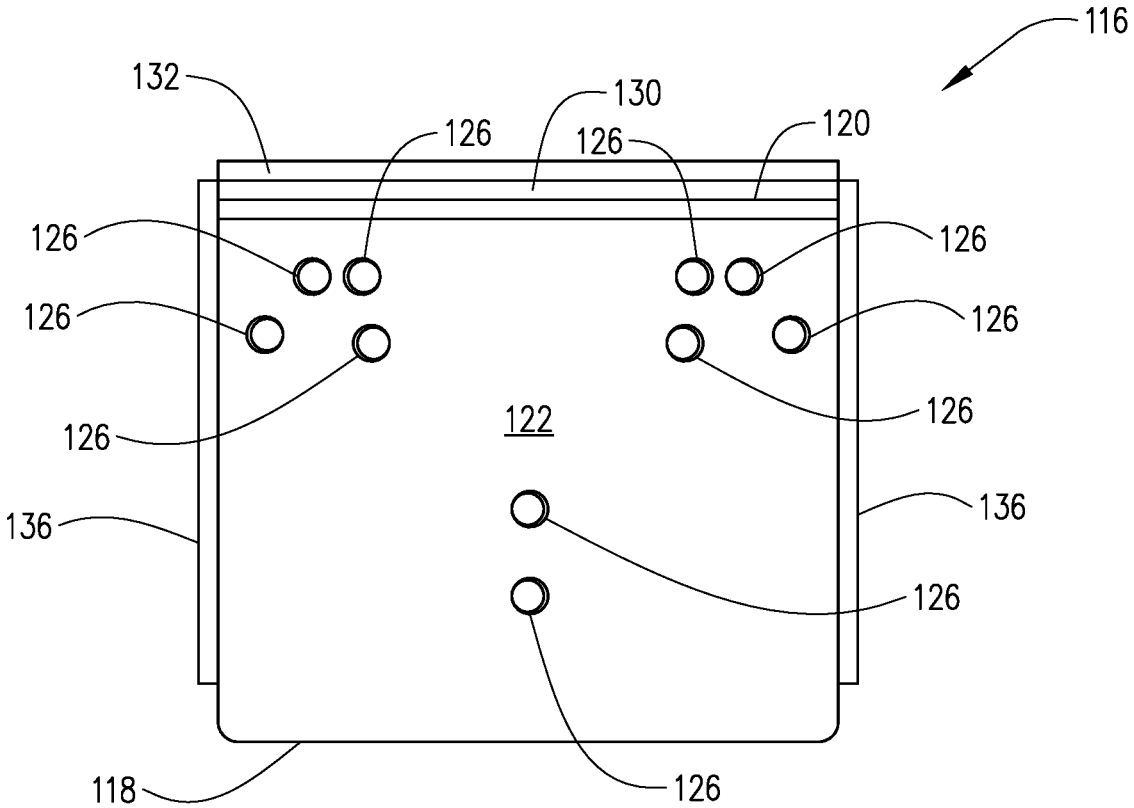

A power transfer lead cover 92, shown in FIG. 14, comprises a tubular shell 94 supported by a frame 96. The shell 94 has a lower end 98 and an upper end 100. The lead cover 92 is installed within a recess at or adjacent the hinge surface 86 of the gate 14, as shown in FIG. 15. The lead cover 92 is positioned such that, when the gate 14 is closed, the lower end 98 of the shell 94 is aligned with the output portal 76.

A cable required to service a lock or appliance enters the gate 14 via the channel 78 formed in the first upright section 24 of the jamb 12. The cable exits channel 78 at output portal 76, and enters the gate 14 at the lower end 98 of the shell 94. The cable traverses the shell 94, exits at upper end 100, and extends into the gate's interior. The shell 94 protects the cable from deformation or damage when the gate 14 swings shut.

In the embodiment shown in FIGS. 25-31, the gate assembly 10 includes only a single gate 14. The gate 14 is installed within the gateway 16 such that the latch surface 84 faces the inner side 32 of the second upright section 26, and the hinge surface 86 faces the inner side 32 of the first upright section 24. Adjacent the hinge surface 86, a plurality of hinges 102 secure the gate 14 to the first upright section 24 of the jamb 12. The hinges 102 project from between the front side 80 of the gate 14 and the front side 18 of the jamb 12. In the embodiment shown in the Figures, three such hinges 102 are provided.

The hinges 102 permit the gate 14 to swing between a closed position, shown in FIGS. 25-28, and an open position, shown in FIG. 29. In its closed position, the gate 14 is fully situated within the gateway 16. In its open position, much or all of the gate 14 is positioned outside the gateway 16, so that individuals or other traffic may traverse the barrier 56 within which the gate assembly 10 is installed.

The gate 14 is preferably provided with a latch mechanism 104. In one embodiment, the latch mechanism 104 is actuatable by a handle 106 installed on the gate's front side 80, and by an exit device 108, such as a panic bar, installed on the gate's rear side 82. In other embodiments, other kinds of hardware may be used to actuate the latch mechanism 104.

Figure 4:
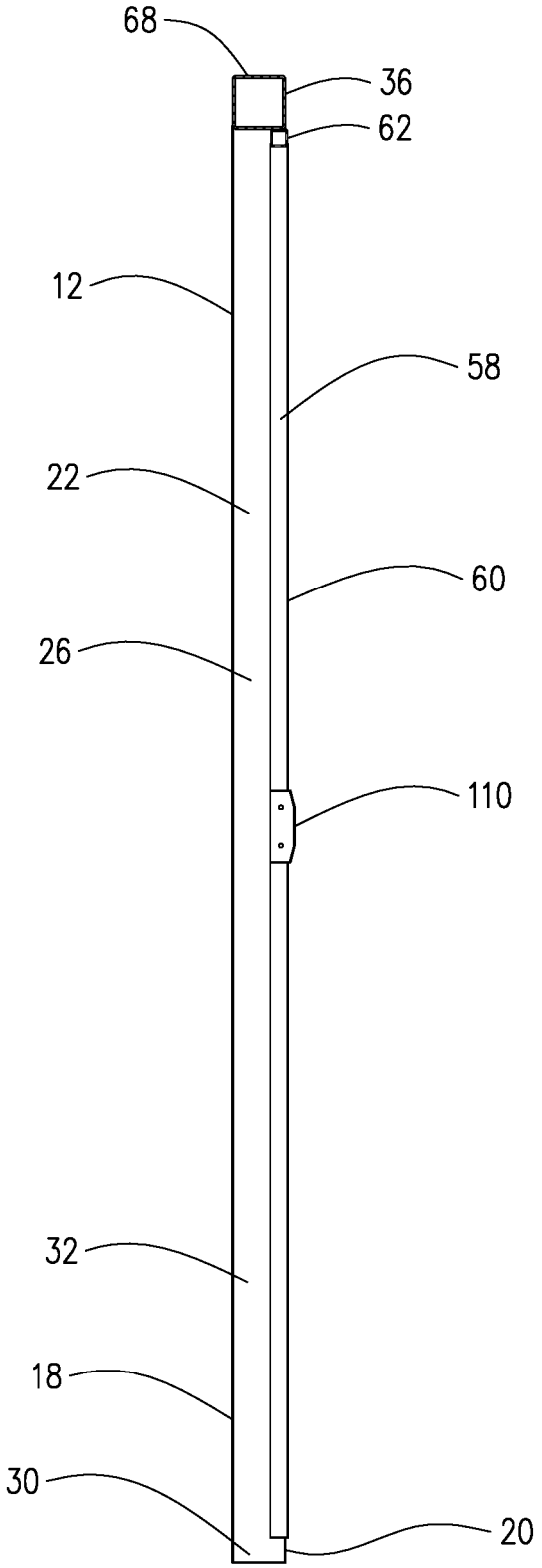
FIG. 4 is a cross-sectional view of the jamb shown in FIG. 1, taken along line 4-4.
Figure 5:
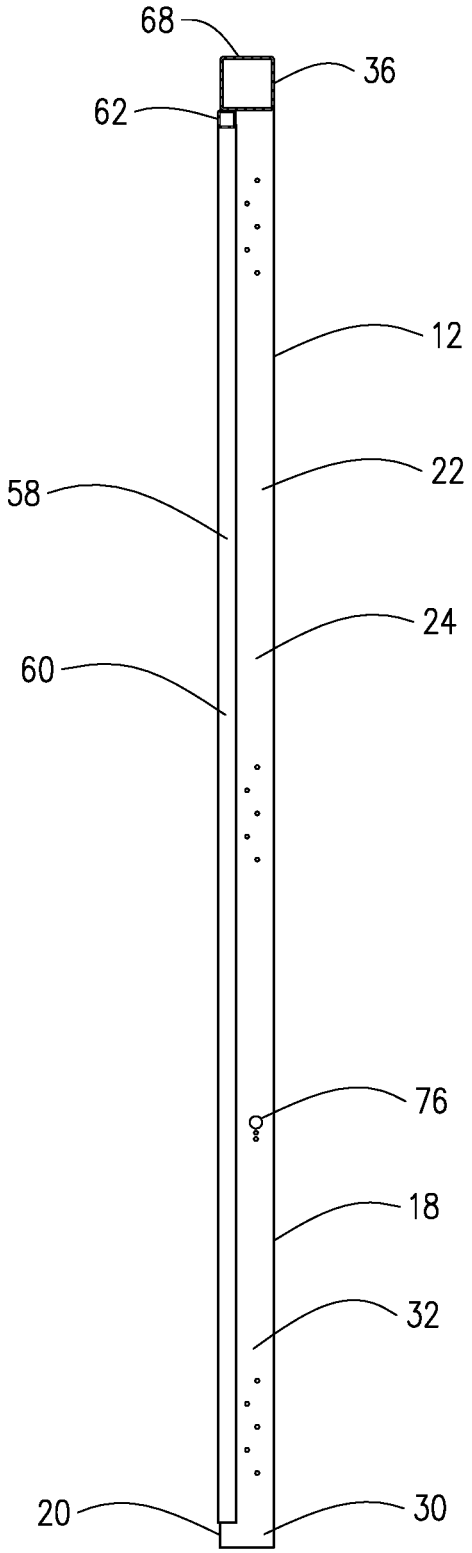
Figure 8:
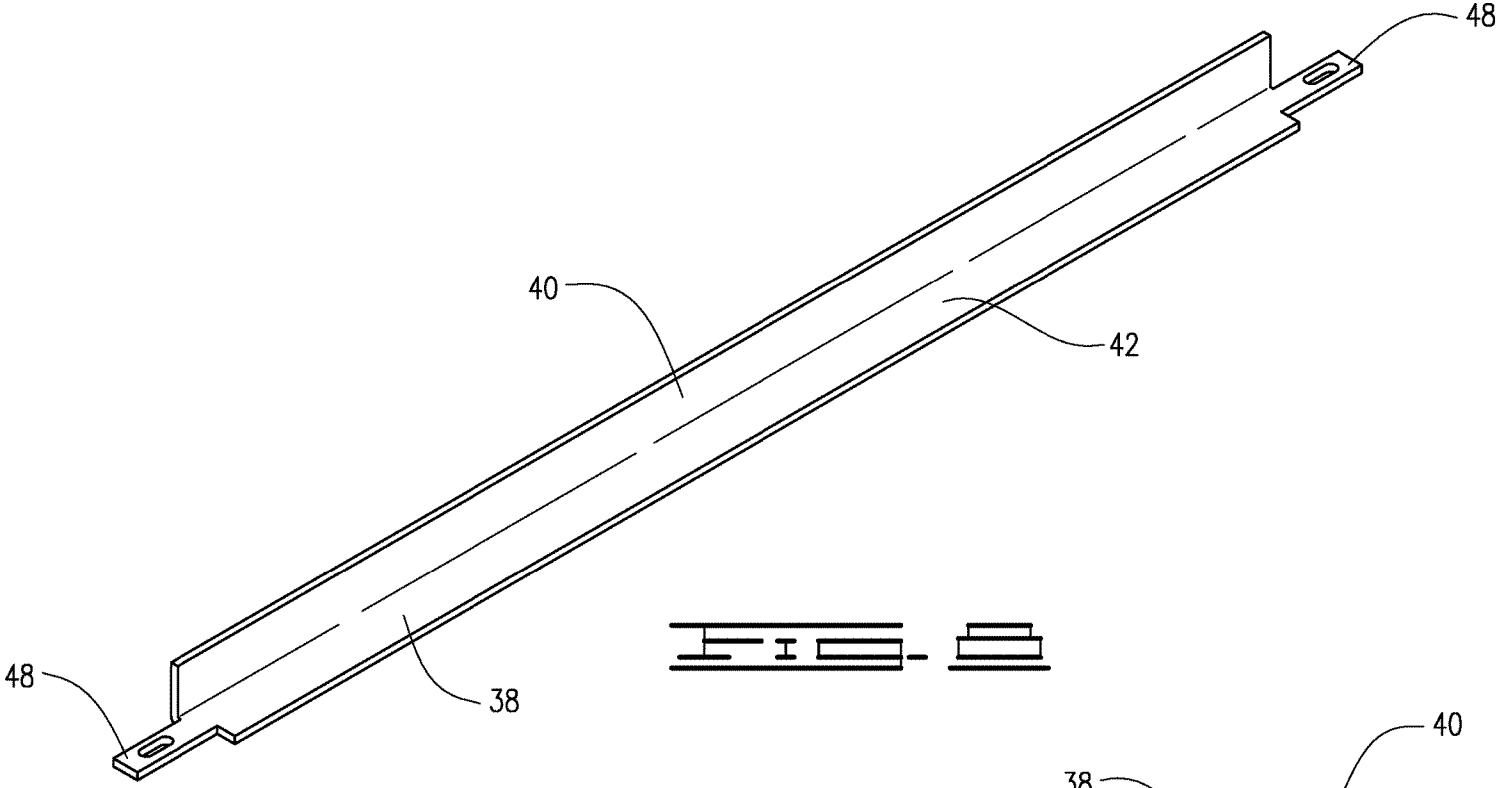
FIG. 8 is a perspective view of a sill section.
Figure 7:
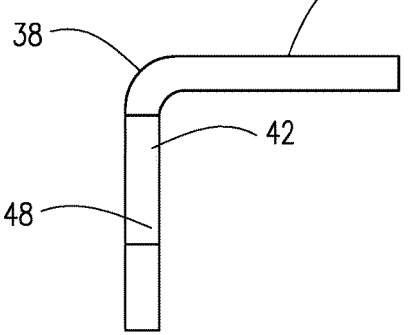
Figure 9:
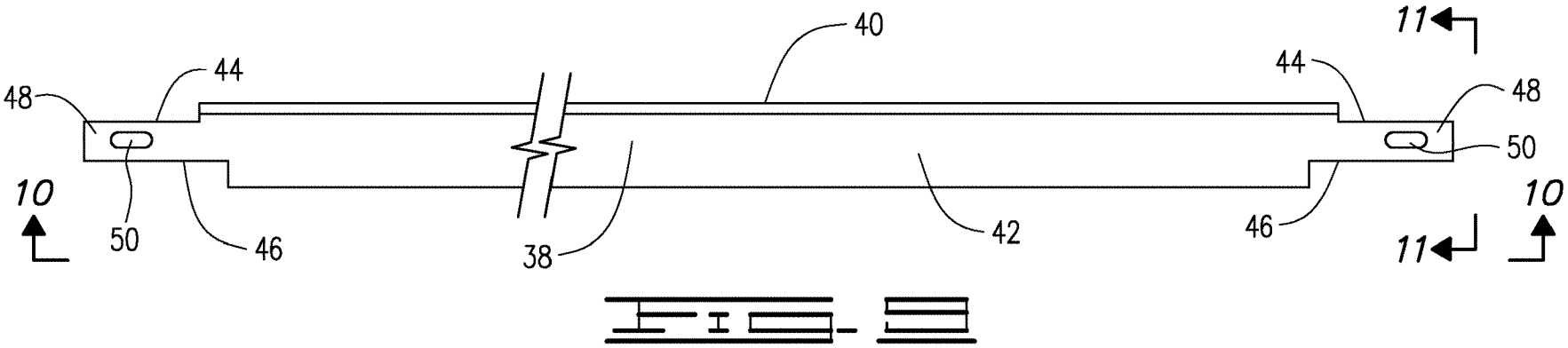
FIG. 9 is a front elevation view of the sill section shown in FIG. 8.
Figure 10:
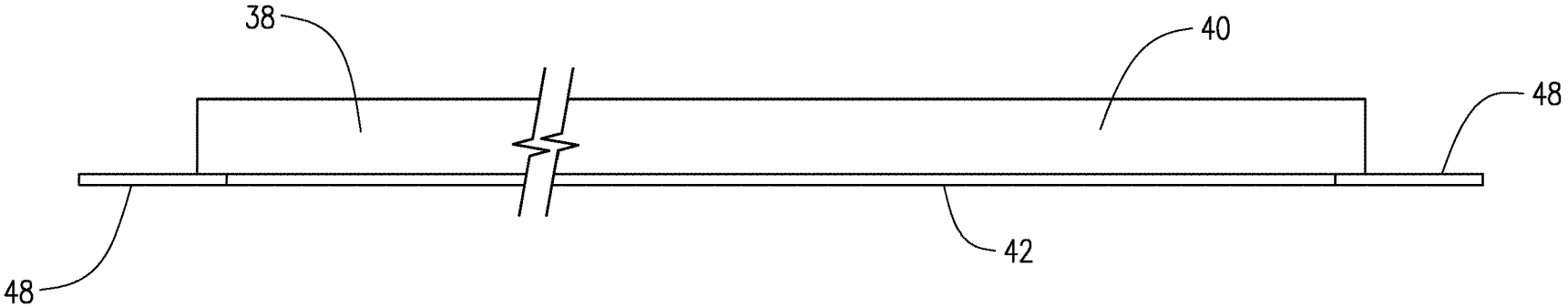
FIG. 10 is a bottom plan view of the sill section shown in FIG. 9, taken along line 10-10.

In the closed position of the gate 14, the bolt of the latch mechanism 104 registers with a strike plate 110 installed on the latch section 26 of the jamb 12. As shown in FIG. 4, the strike plate 110 is preferably interposed within the stop 58.

The gate 14 is optionally provided on its rear side 82 with a mechanical closer 112, shown in FIGS. 26-29, which preferably includes an articulated arm 114. The closer 112 is connected to the rear side 20 of the jamb 12, biases the gate 14 toward its closed position and prevents slamming. A closer attachment bracket 116, shown in detail in FIGS. 16-19, is supported by the jamb 12 and engages the arm 114 at or adjacent one of its ends.

The closer attachment bracket 116 is formed a base section 118 and an upright section 120. The base section 118 is preferably flat, and has opposed first and second sides 122 and 124. Preferably, the base section 118 has a rectangular shape.

A plurality of compact fastener openings 126 penetrate the base section 118. Preferably, the fastener openings 126 are distributed symmetrically about a line bisecting the base section 118. In the embodiment shown in the Figures, ten such fastener openings 126 are formed. Two openings 126 are located on the bisecting line. Two other clusters of openings 126 are situated on opposite sides of the same bisecting line. Each such cluster includes four openings 126.

The upright section 120 adjoins the base section 118 adjacent its first side 122, and extends in transverse relationship to the base section 118. Preferably, the base and upright sections 118 and 120 comprise regions of the same single piece of material, with a fold in the material forming the boundary between the sections. The upright section 120 preferably comprises a lower panel 128, an intermediate panel 130, and an upper panel 132.

Each of the panels 128, 130 and 132 is preferably flat and rectangular in shape. The lower panel 128 joins the base section 118 at one of its edges, and joins the intermediate panel 130 at an opposite edge. The intermediate panel 130 joins the upper panel 132 at an edge opposite its junction with the lower panel 128. At the edge opposite its junction with the intermediate panel 130, the upper panel 132 has a free end. Preferably, the lower and upper panels 128 and 132 are parallel, with the upper panel 132 having the greatest offset from the base section 118. Preferably, the lower and upper panels 128 and 132 extend in orthogonal relationship to the base section 118.

A plurality of oblong fastener openings 134 penetrate the upright section 120. Preferably, the openings 134 are formed in the upper panel 132, and are distributed symmetrically about a line bisecting that upper panel 132. In the embodiment shown in the Figures, three such fastener openings 134 are formed. One of the openings 134 is located on the bisecting line. Two other openings 134 are situated on opposite sides of the same bisecting line.

One or more gussets 136 interconnect the base section 118 and the upright section 120, preferably at the upper panel 132. Each gusset 136 is permanently secured to the sections 118 and 120, preferably by welding. The gussets 136 strengthen the bracket 116 and enhance its resistance to deformation. The embodiment of the bracket 116 shown in the Figures includes two gussets 136, with one situated on each side of the bracket 116.

The bracket 116 is installed by engaging the upright section 120 and the jamb 12. More particularly, the upper panel 132 is placed flush against the rear side 20 of the header section 36. Fasteners (not shown) are inserted into one or more of the fastener openings 134 and actuated to secure the bracket 116 to the jamb 12. At or adjacent its end, the arm 114 of the closer 112 is connected to the base section 118 of the bracket 116. Fasteners (not shown) are inserted into one or more of the fastener openings 126 and through mating openings (not shown) formed in the arm 114. These fasteners are similarly actuated to connect the closer 112 to the bracket 116.

Figure 20:
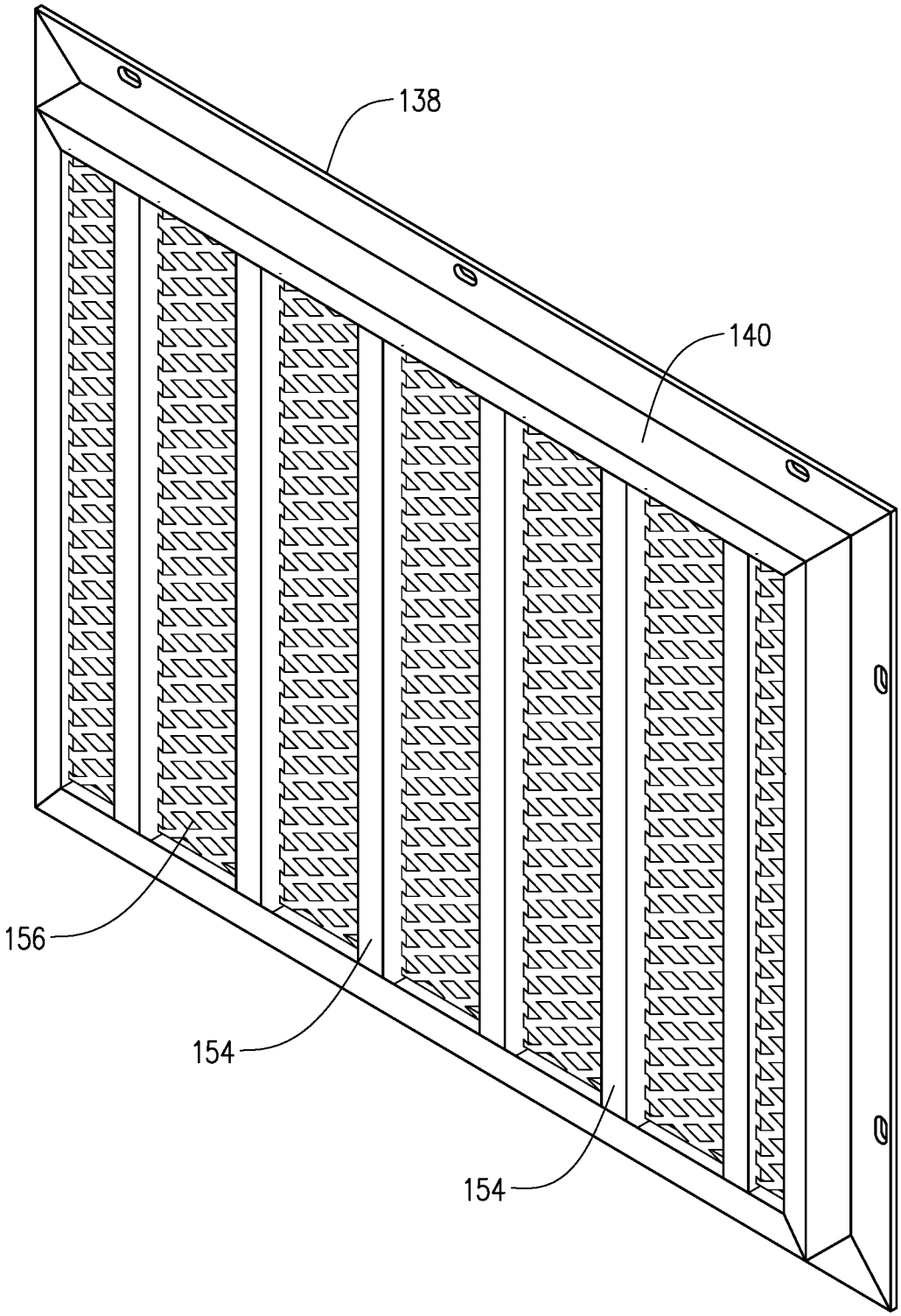
FIG. 20 is a perspective view of an window panel.
Figure 21:
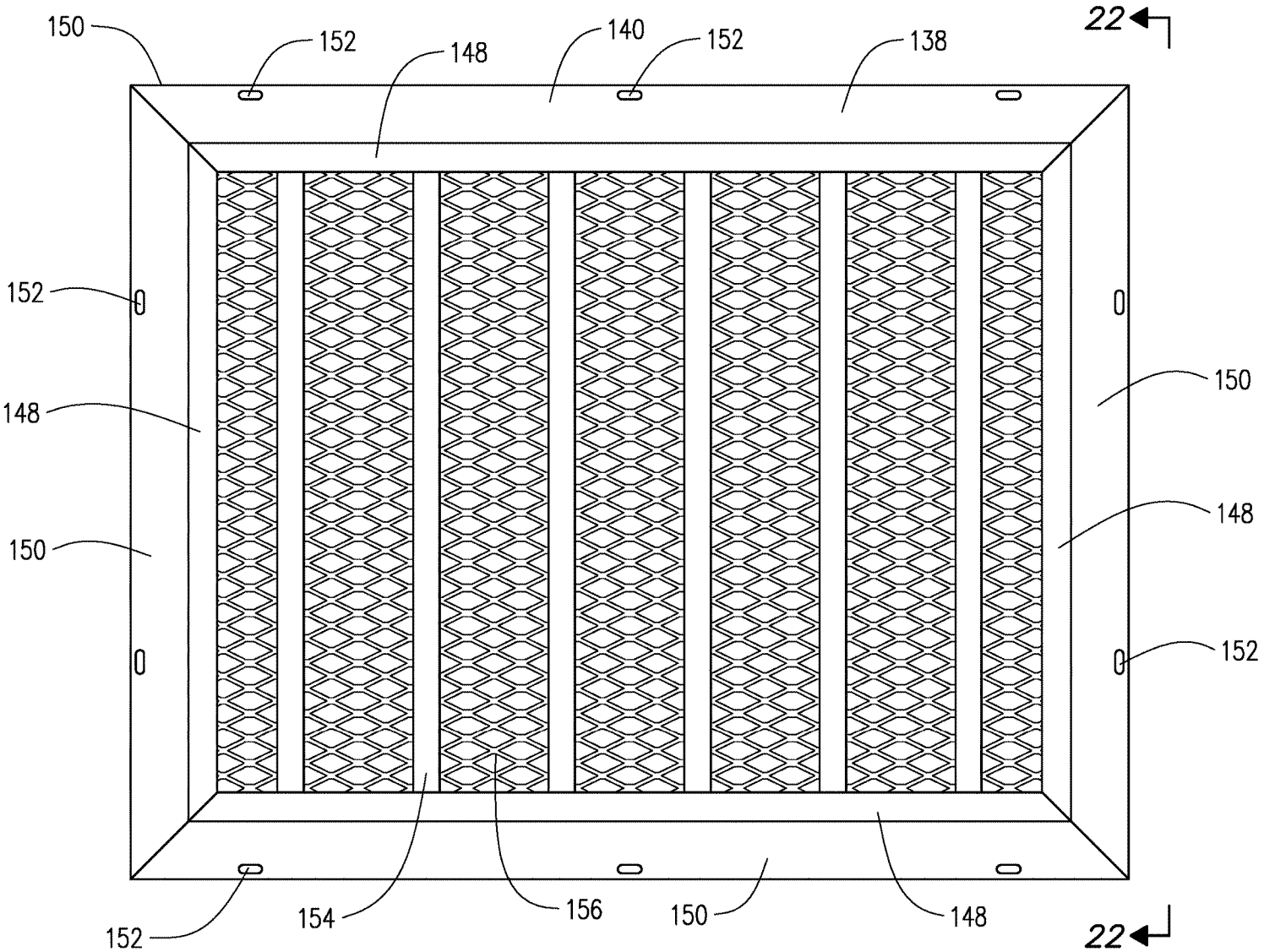
FIG. 21 is a front elevation view of the window panel shown in FIG. 20.
Figure 22:
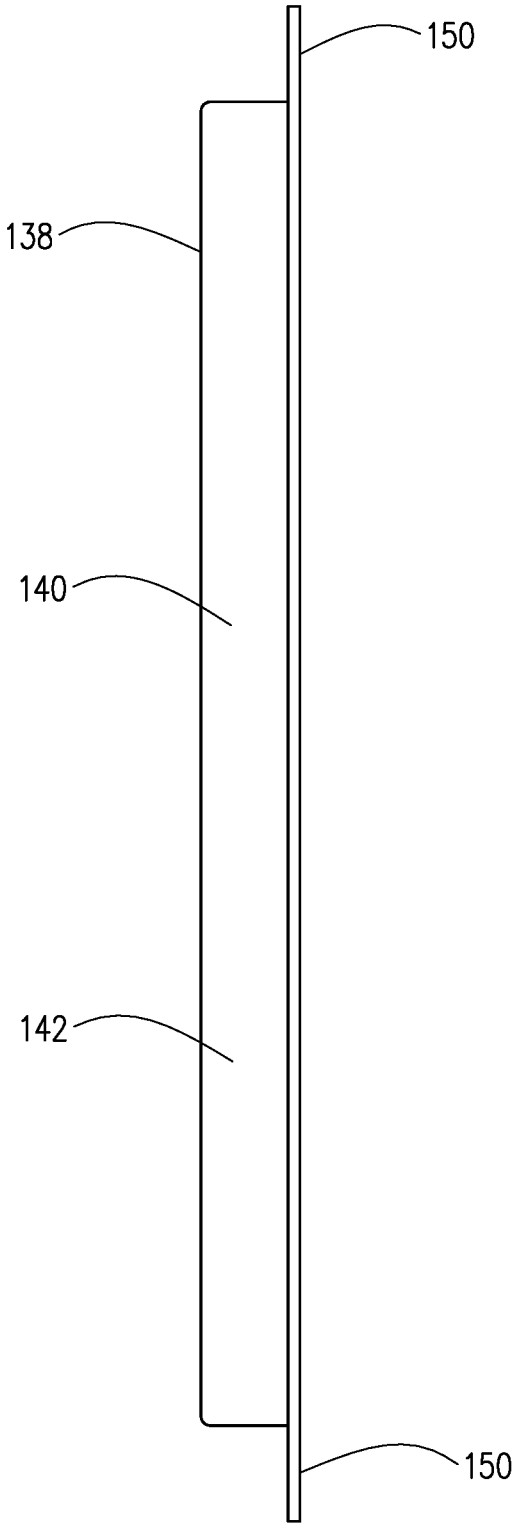
FIG. 22 is a side elevation view of the window panel shown in FIG. 21, taken along line 22-22.

The gate 14 further comprises at least one modular window panel 138, best shown in FIGS. 20-24. Each window panel 138 is adapted for removable installation within a respective window opening 88 of the gate 14, and is in fact so installed. Preferably, the number of window panels 138 equals the number of window openings 88. Each window panel 138 comprises a frame 140 formed from a strong and durable material such as steel. As shown in FIGS. 21 and 22, the frame 140 includes a open-ended box-like body 142 having a rectangular cross-sectional shape, a first longitudinal edge 144 and an opposed second longitudinal edge 146. The body 142 has four sides, each comprising a rectangular strip of material.

A first flange 148 extends peripherally from the body 142 at its first longitudinal edge 144. A second flange 150 extends peripherally from the body 142 at it second longitudinal edge 146. The flanges 148 and 150 extend in opposite directions from the body 142. Each flange 148 and 150 also extends orthogonally to that portion of the body 142 to which it joined. As a result, the cross-sectional shape of the frame 140 somewhat resembles the letter "S". As shown in FIGS. 20 and 21, a plurality of peripherally spaced fastener openings 152 are formed in the second flange 150.

A plurality of spaced and parallel pickets 154 are installed within the body 142 adjacent its first longitudinal edge 144. A strip of infill material 156, such as wire mesh, is secured within the body 142 adjacent its second longitudinal edge 146. The infill material 156 should be sized to fully cover the interior of the body 142. The pickets 154 and infill material 156 cooperate to block access through the window opening 88 within which the window panel 138 is installed. The pickets 154 and infill material 156 are secured within the interior of the frame 140 by welding or fasteners. Preferably, the pickets 154, infill material 156 and frame 140 are joined permanently.

Figure 23:
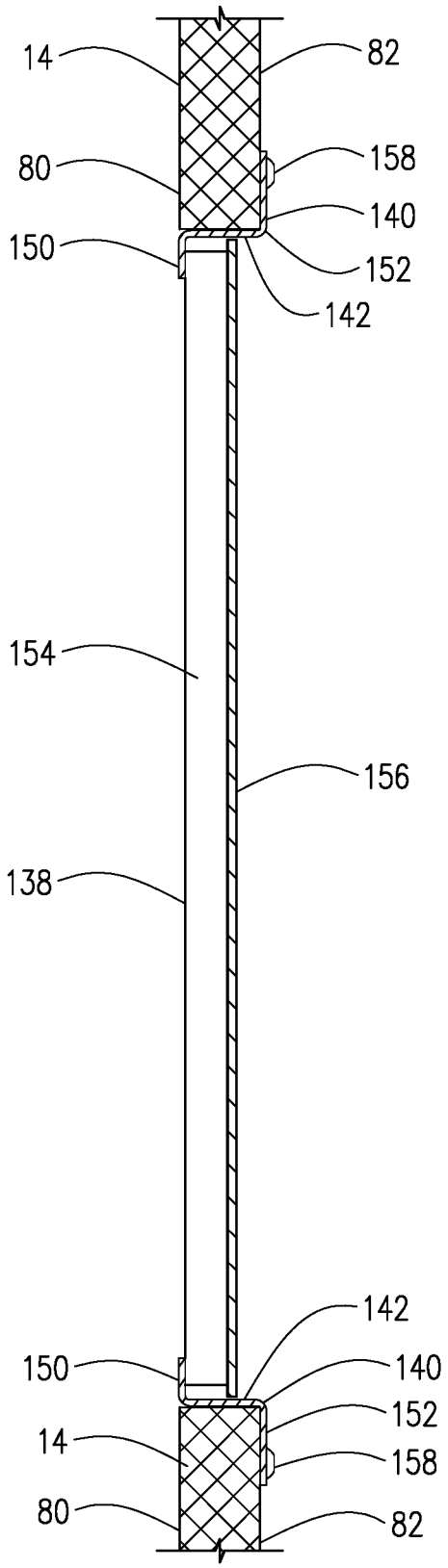
FIG. 23 is a cross-sectional view showing the window panel of FIG. 21 in an installed position within a window opening of a gate.
Figure 24:
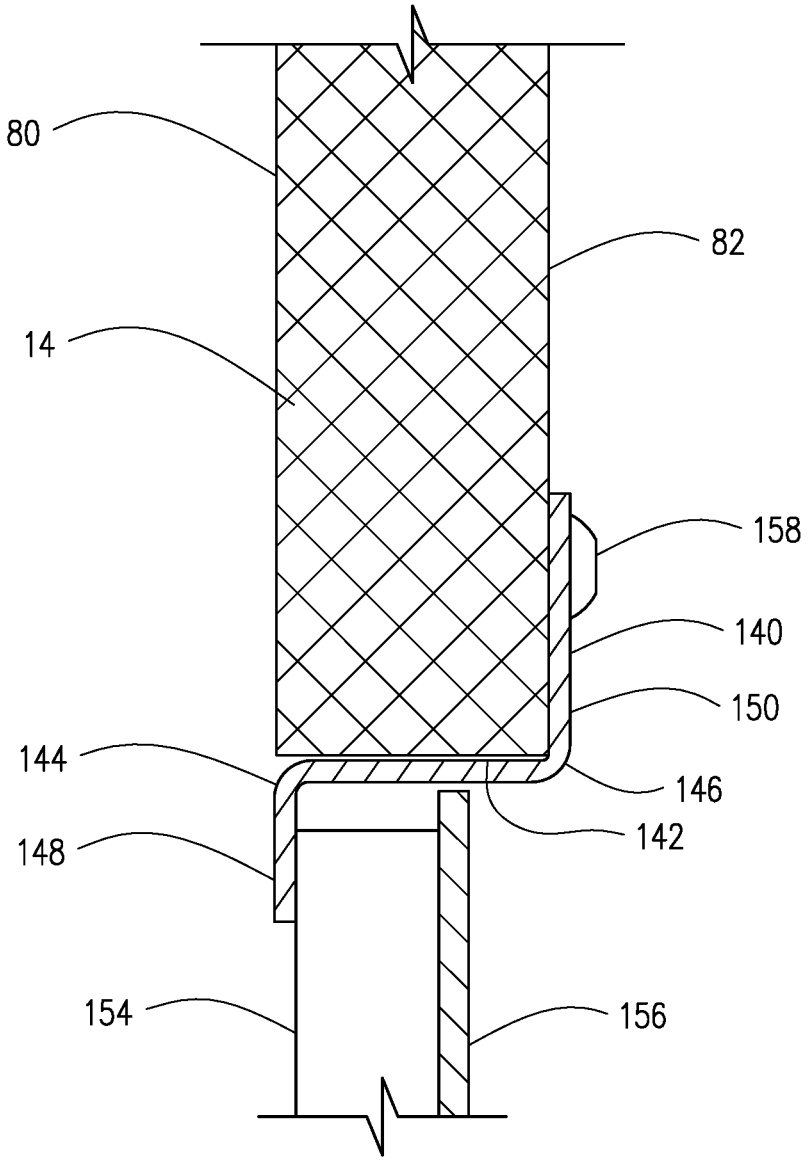
FIG. 24 is an enlarged view of a portion of FIG. 23, showing the panel-gate connection in greater detail.

A window panel 138 is installed in the gate 14 by positioning the body 142 within the window opening 88. Thus installed, the first flange 148 seats flush against the front side 80. Similarly, the second flange 150 seats flush against the rear side 82, and the fastener openings 152 and 90 are aligned. As shown in FIGS. 23 and 24, fasteners 158, such as bolts, are inserted through the aligned fastener openings and actuated to secure the window panel 138 to the gate 14. Because the window panel 138 is modular and removable, the gate assembly 10 can accommodate a wide variety of infill materials and panel styles.

The gate assembly 10 further comprises an elongate first bracket 160 and an elongate second bracket 162, shown in FIGS. 25-29. The brackets 160 and 162 are preferably identical in size, shape and construction, and formed from a strong and durable material, such as steel or aluminum. Suitable steels include carbon steel and stainless steel. Each of the brackets 160 and 162 has an L-shaped cross section and includes a first leg 164 and a second leg 166 that are joined at a common edge. Each of the legs 164 and 166 is flat, with one extending orthogonally to the other. The first leg 164 of each of the brackets 160 and 162 is preferably substantially coextensive, both longitudinally and laterally, with the flat outer side 34 of the jamb section 22 that will support and engage it.

Figure 27:
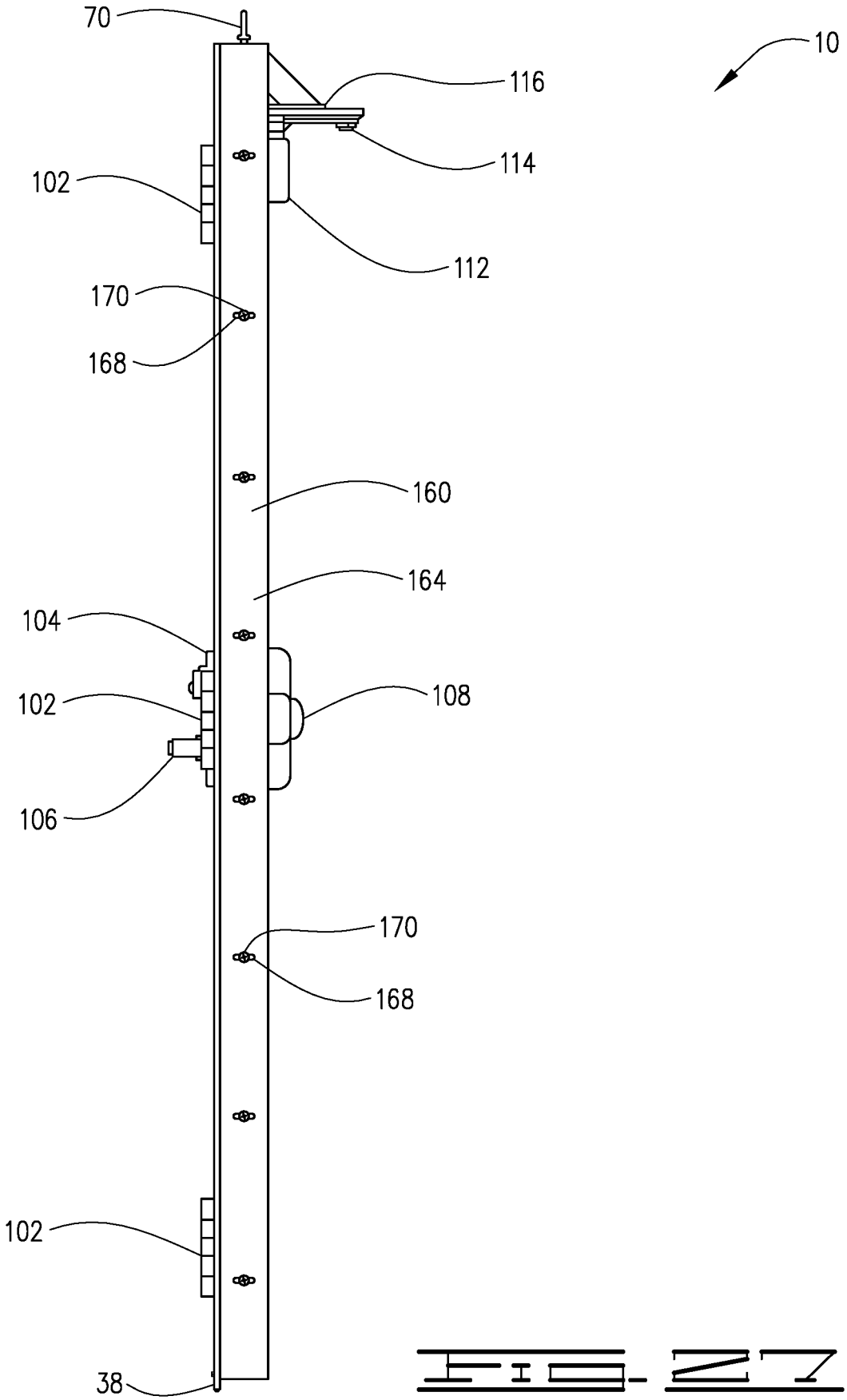
FIG. 27 is a side elevation view of the gate assembly shown in FIG. 25, taken along line 27-27.
Figure 12:
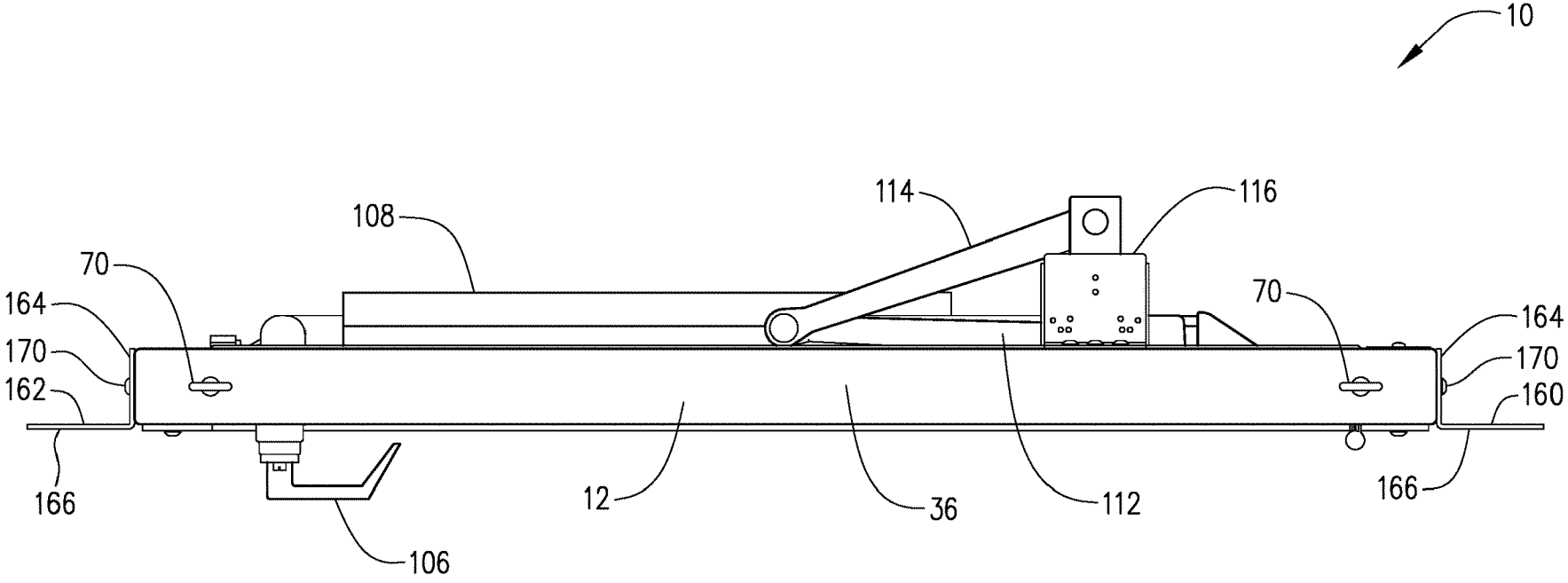
Figure 25:
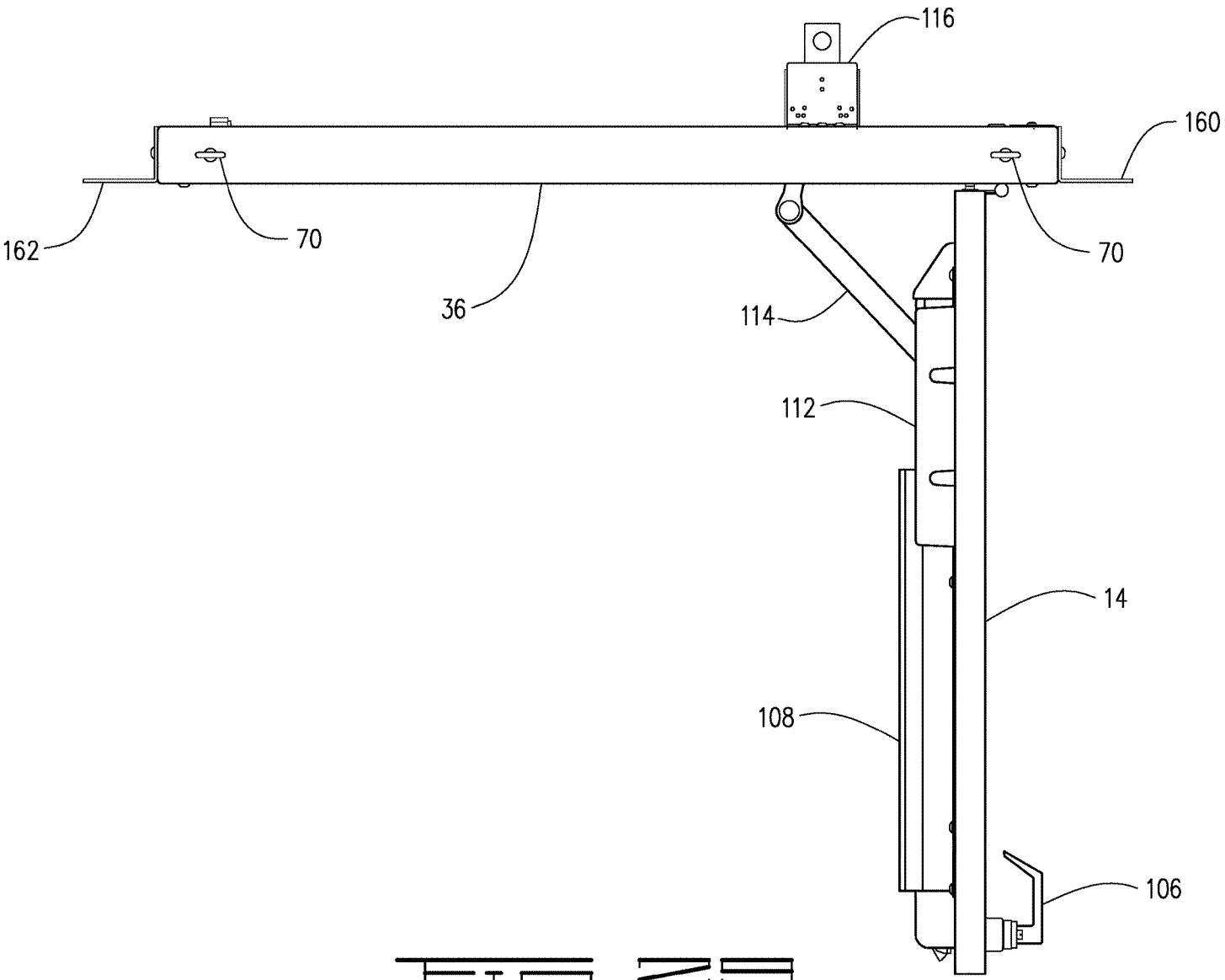

The first leg 164 of the first bracket 160 is seated flush against the flat outer side 34 of the first upright section 24, as shown in FIG. 28. With the first leg 164 thus seated, fastener openings 168 in the first leg 164 register with corresponding openings (not shown) in the outer side 34 of the first upright section 24. As shown in FIG. 27, fasteners 170, such as bolts, are inserted into the aligned fastener openings and actuated to secure the first bracket 160 to the first upright section 24.

When the first leg 164 of the first bracket 160 is secured to the first upright section 24, the second leg 166 should be situated nearest the front side 18 of the jamb 12.

The second leg 166 projects away from the gateway 16, while extending parallel to it. The second leg 166 of the first bracket 160 also extends orthogonally to the nearest surface of its supporting section of the jamb 12, namely the outer side 34 of first upright section 24. A plurality of fastener openings 172 are formed in the second leg 166, as shown in FIGS. 25 and 26.

The first leg 164 of the second bracket 162 is seated flush against the flat outer side 34 of the second upright section 26, as shown in FIG. 28. With the first leg 164 thus seated, fastener openings (not shown) in the first leg 164 register with corresponding openings (not shown) in the outer side 34 of the second upright section 26. Fasteners (not shown), such as bolts, are inserted into the aligned fastener openings and actuated to secure the second bracket 162 to the second upright section 26.

When the first leg 164 of the second bracket 162 is secured to the second upright section 26, the second leg 166 should be situated nearest the front side 18 of the jamb 12. The second leg 166 projects away from the gateway 16, while extending parallel to it. The second leg 166 of the second bracket 162 also extends orthogonally to the nearest surface of its supporting section of the jamb 12, namely the outer side 34 of second upright section 26. A plurality of fastener openings 172 are formed in the second leg 166 of the second bracket 162, as shown in FIGS. 25 and 26. When both of the brackets 160 and 162 are installed on the jamb 12, the projecting second legs 166 are coplanar. Each of the brackets 160 and 162 is a mirror image of the other.

Preferably, the gate 14 is "prehung" on the jamb 12 at a manufacturing facility. As a result, little, if any adjustment between gate and jamb is required at the site where the gate assembly 10 is to be installed. Instead, installation is simply a matter of attaching the coplanar second legs 166 to the coplanar surfaces of a pair of gate posts. Because the brackets 160 and 162 can be inserted between any pair of posts that present coplanar flat surfaces, the gate assembly 10 can be incorporated into a wide variety of barriers.

FIG. 30 shows a barrier 56, in the form of a fence, installed on an outdoor terrain 174. The barrier 56 includes a gate opening 176 bounded by a pair of gate posts 178. The gate assembly 10 is installed by positioning the jamb 12 and gate 14 within the gate opening 176. As this is done, the coplanar second legs 166 are brought into flush engagement with the flat and coplanar surfaces of the gate posts 178. Fastener openings 172 in the second legs 166 are next aligned with corresponding openings (not shown) in the gate posts 178. Finally, fasteners 180 are inserted into the aligned openings and actuated to secure the gate assembly 10 to the gate posts 178, and thus the barrier 56. Once assembly is complete, the sill section 38 of the jamb 12, and the eye bolts 70, are preferably removed, as shown in FIG. 30.

Figure 31:
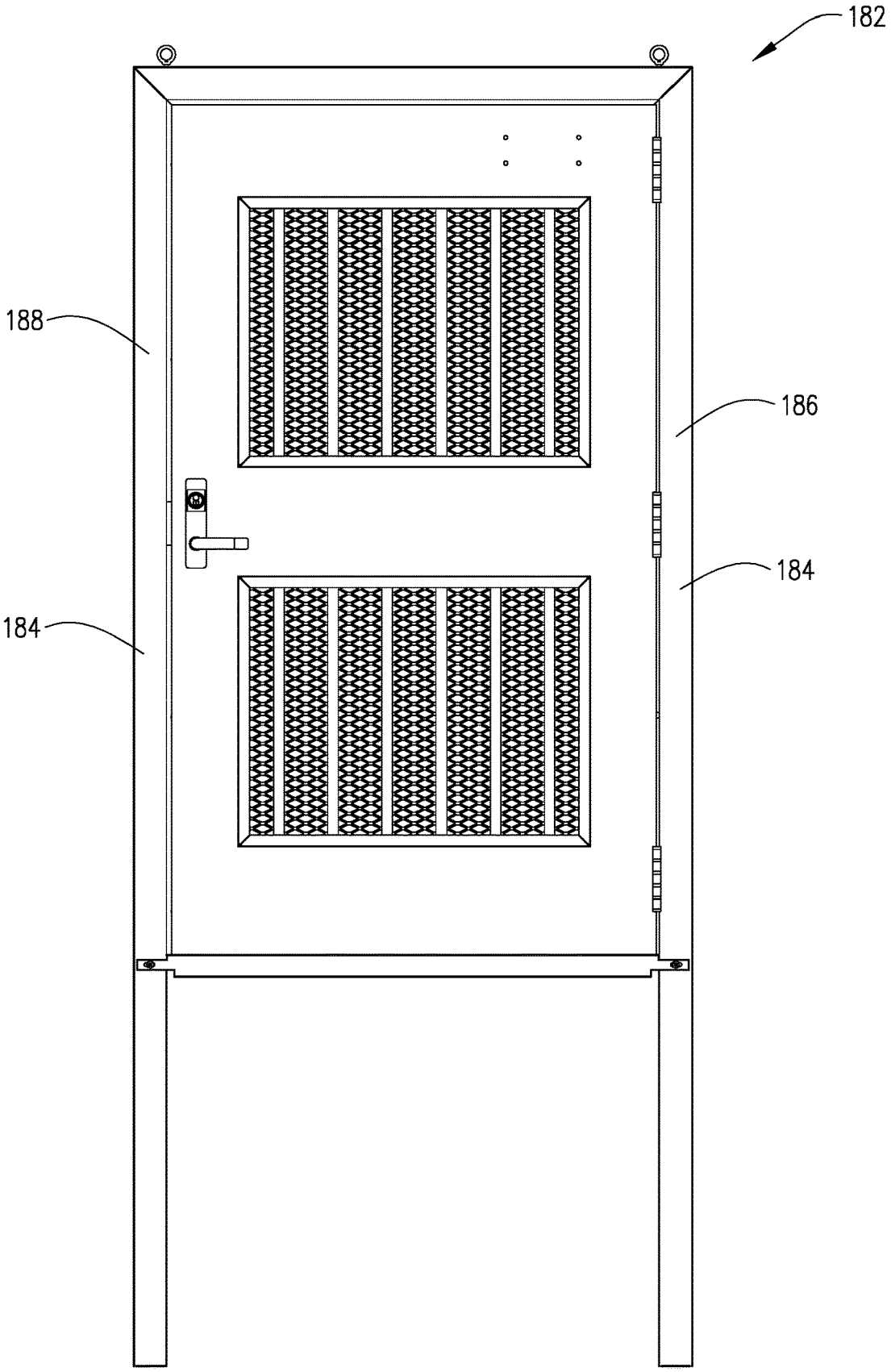
FIG. 31 is a front elevation view of another embodiment of a gate assembly.

FIG. 31 shows another embodiment of a gate assembly, designated by reference numeral 182. This embodiment does not include the brackets 160 and 162. Instead, the upright jamb sections 184, namely first upright section 186 and second upright section 188, are much longer than the corresponding upright jamb sections 22 of the gate assembly 10. The lower portions of the upright jamb sections 184 are buried in order to install the gate assembly 182. In one embodiment, the upright jamb sections 184 have an outside length of 120 inches. Other features of the gate assembly 182 are identical to those described with reference to the gate assembly 10.

Figure 32:
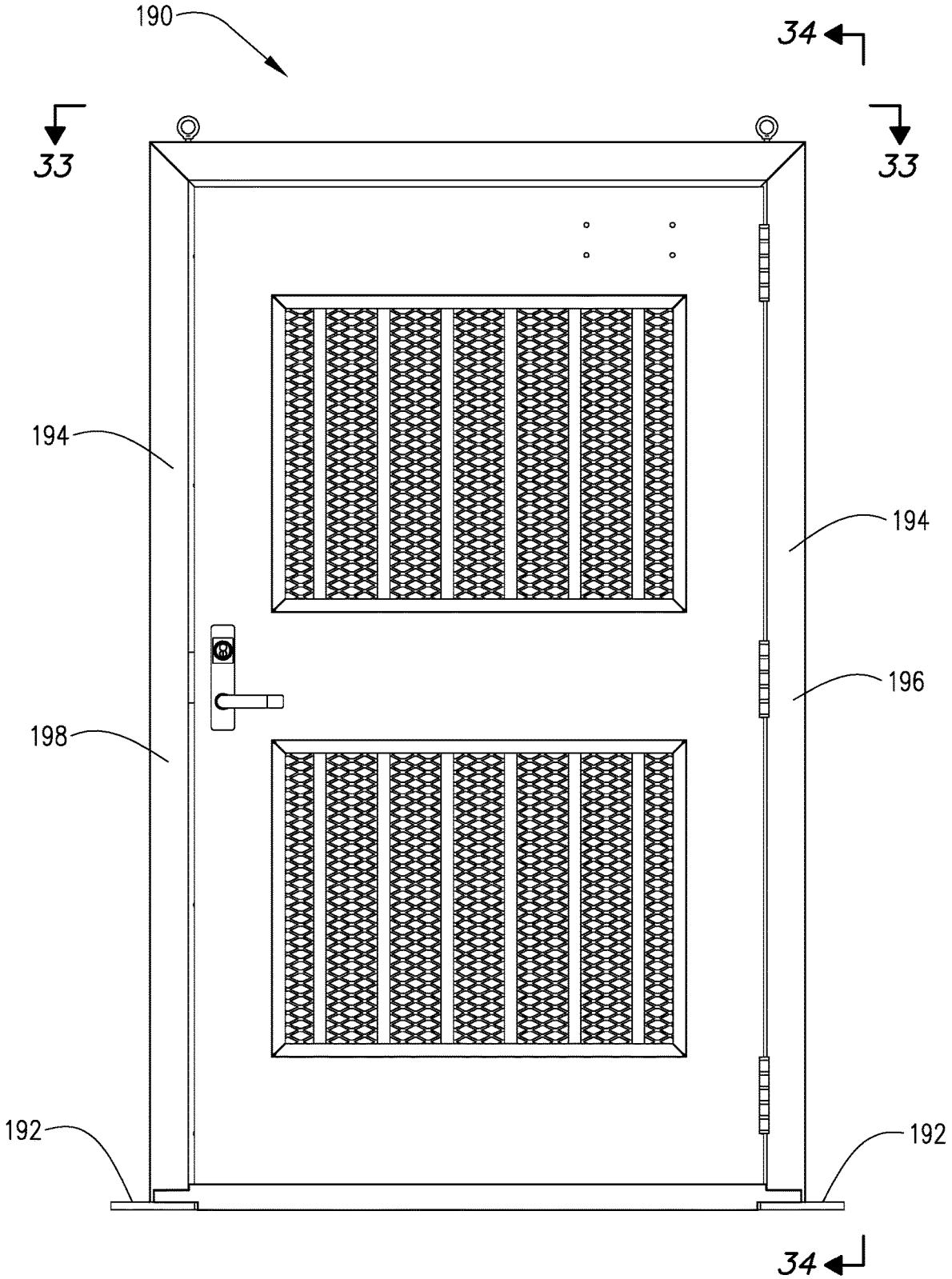
FIG. 32 is a front elevation view of another embodiment of a gate assembly.
Figure 34:
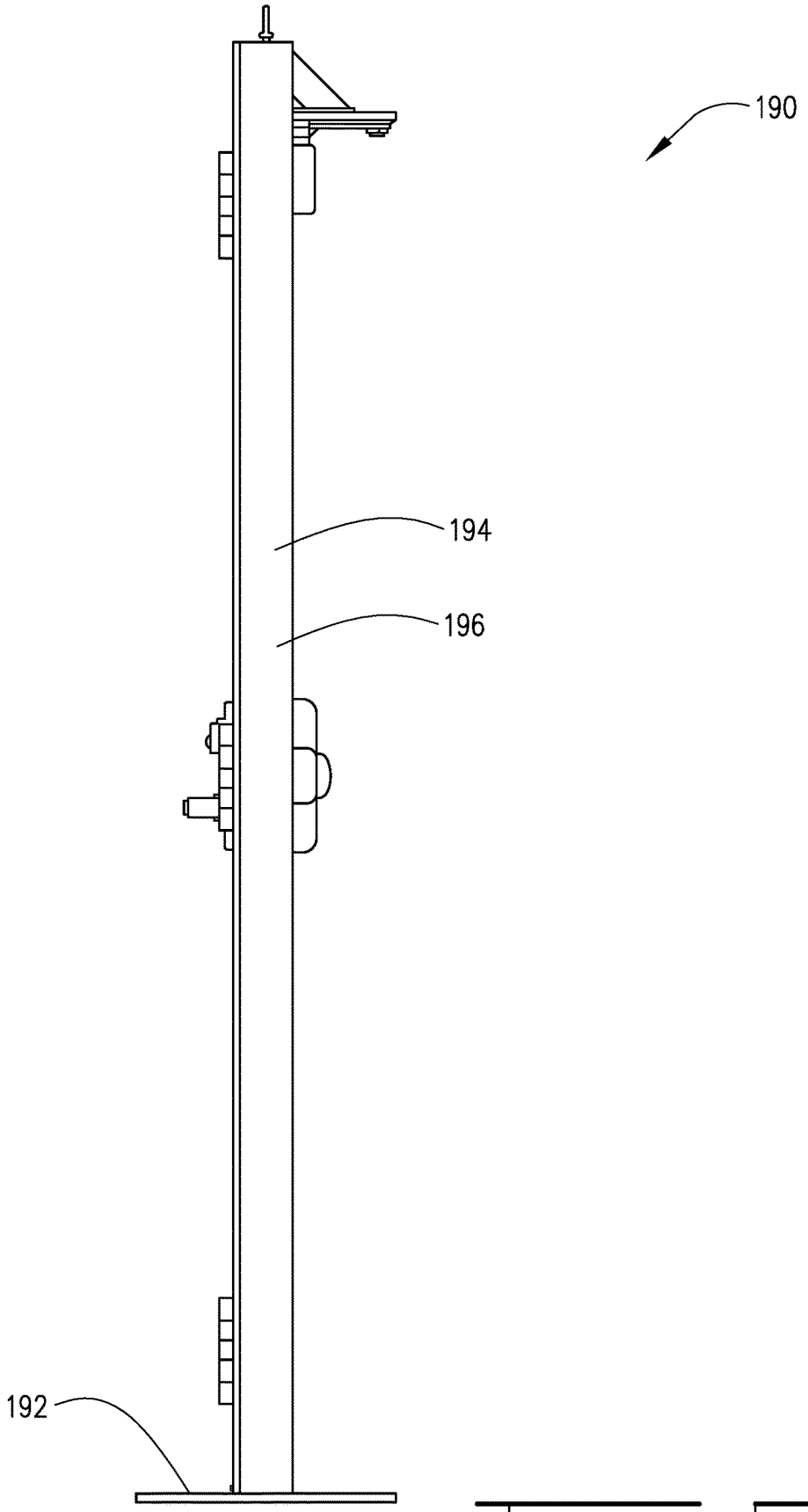
FIG. 34 is a side elevation view of the gate assembly shown in FIG. 32, taken along line 34-34.
Figure 35:
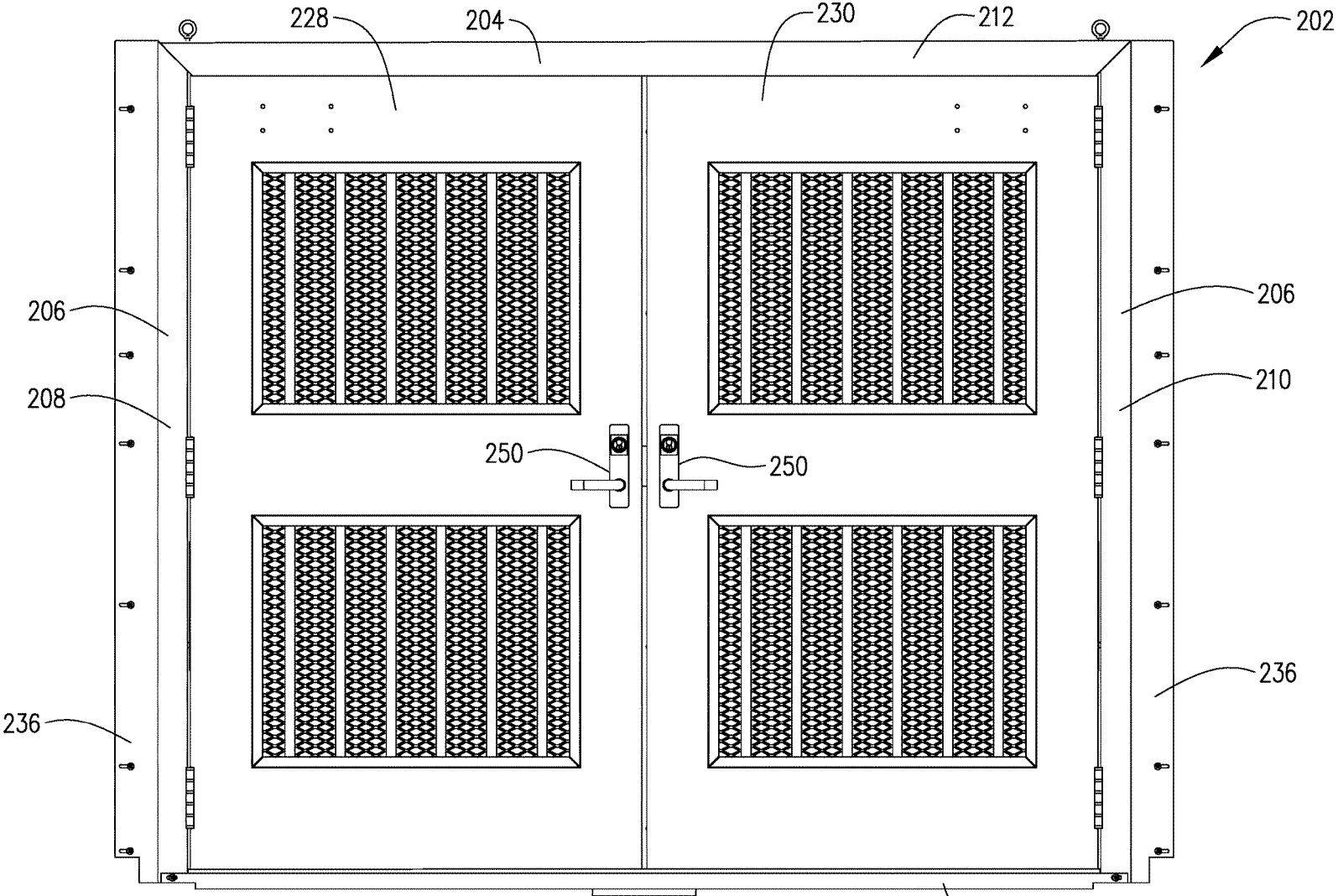
Figure 35:
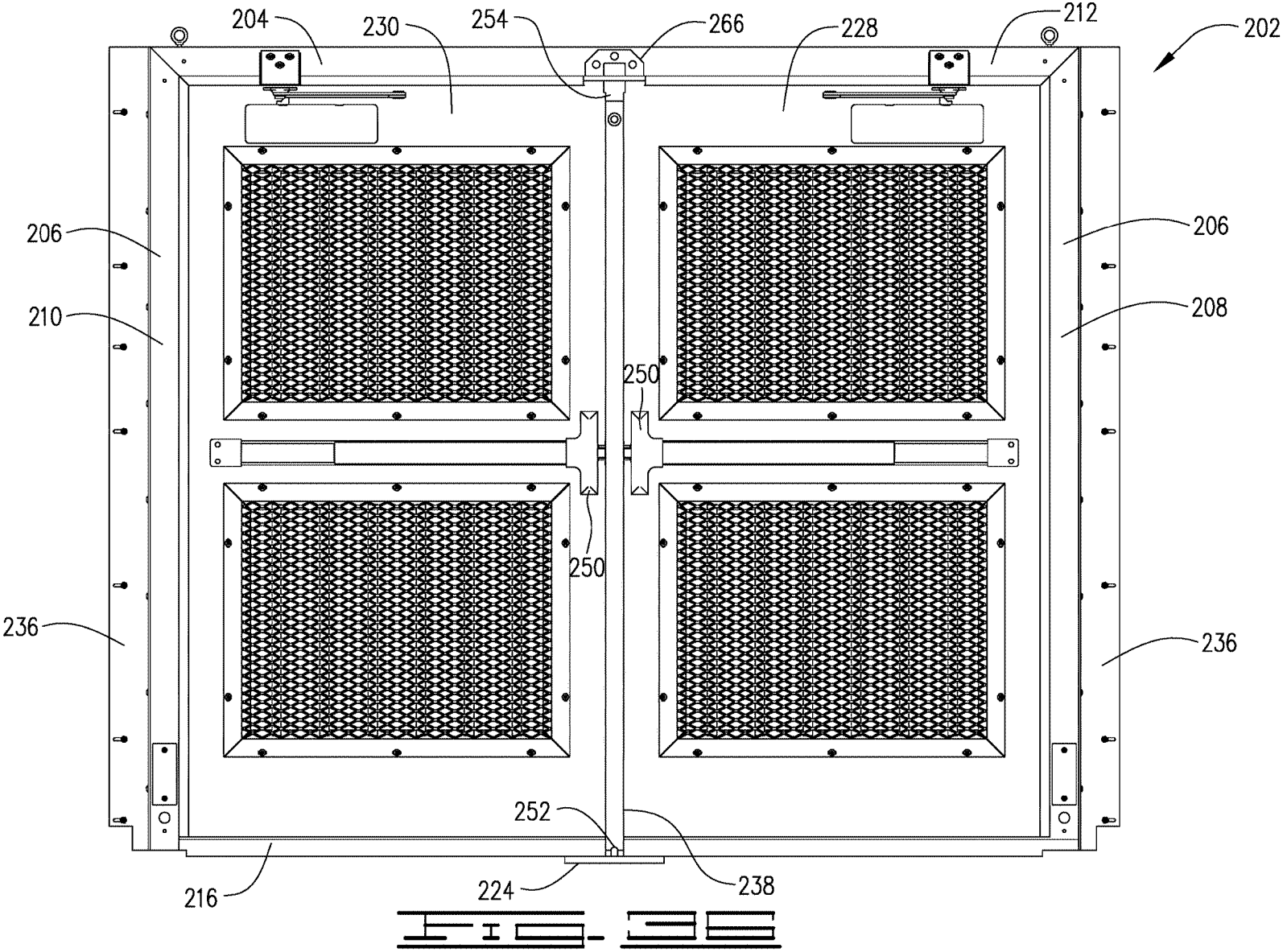

FIGS. 32-34 show another embodiment of a gate assembly, designated by reference numeral 190. Like the gate assembly 182, this embodiment does not include the brackets 160 and 162. Instead, flat plates 192 are secured to the base of each of the upright jamb sections 194, namely first upright section 196 and second upright section 198. Each plate 192 extends orthogonally to the longitudinal axis of its associated jamb section 194, and preferably is secured to it permanently, such as by welding. A plurality of fastener openings 200 are formed in each plate 192 about the periphery of its associated upright jamb section 194. Fasteners (not shown), such as bolts, are inserted through the fastener openings 200 and actuated to secure the plate 192 to a substrate (not shown), such as a concrete footing or slab. Other features of the gate assembly 190 are identical to those described with reference to the gate assembly 10.

Figure 35:
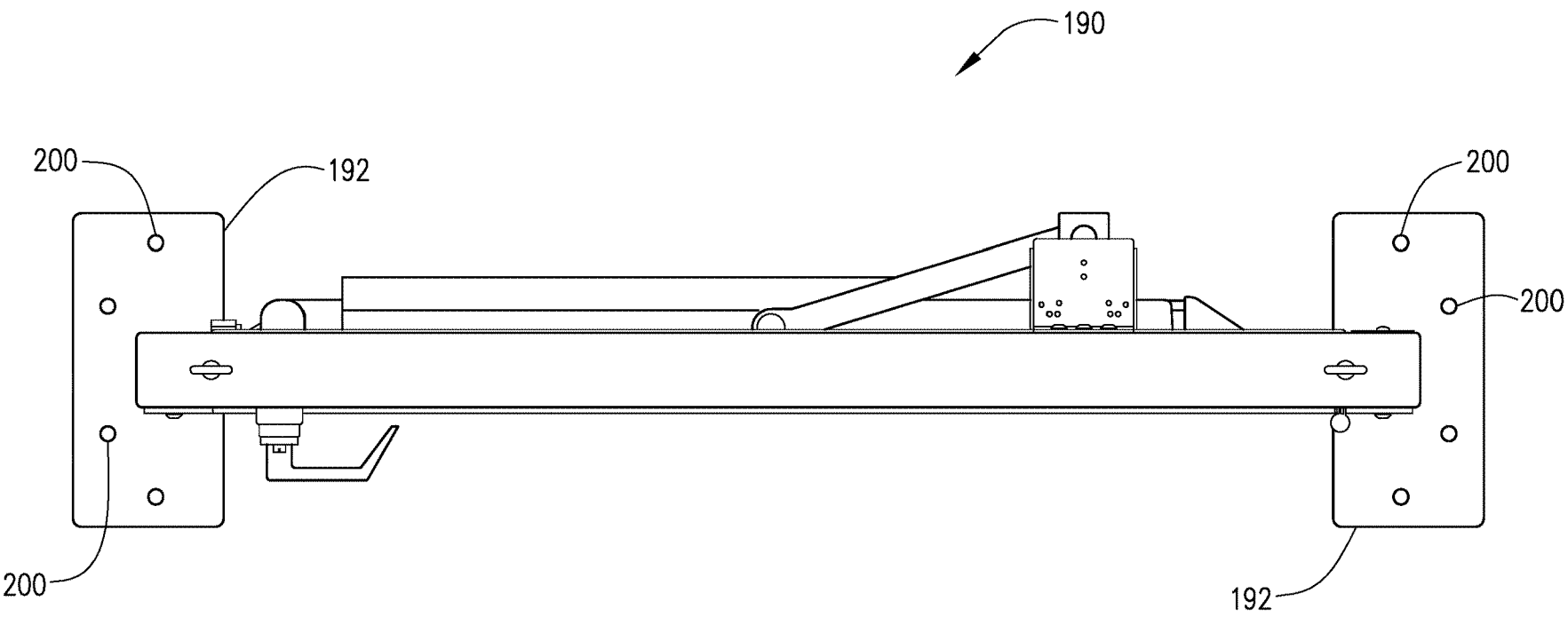
FIG. 35 is a front elevation view of another embodiment of a gate assembly.

FIGS. 35 and 36 show another embodiment of a gate assembly, designated by reference numeral 202. The gate assembly 202 comprises a jamb 204, shown in FIG. 37. The jamb 204 is formed from a pair of elongate upright jamb sections 206, namely first upright section 208 and second upright section 210. The upright jamb sections 206 are joined at their upper ends by an orthogonal header section 212. The upright jamb sections 206 and header section 212 form boundaries of a gateway 214.

Features of the upright sections 208 and 210 and header section 212 are identical to the corresponding sections of the jamb 12, except that the header section 212 is longer than the header section 36. The greater length of the header section 212 permits the gateway 214 to accommodate dual gates, rather than the single gate 14 of the gate assembly 10.

Preferably, the jamb 204 further comprises a removable sill section 216, best shown in FIGS. 38-41. The sill section 216 interconnects the lower ends of the upright jamb sections 206 and forms another boundary of the gateway 214. The sill section 216 is preferably an elongate L-shaped structure formed having opposed ends 218. The sill section 216 is characterized by an upper leg 220 and an orthogonal lower leg 222. Except as noted, features of the sill section 216 are identical to corresponding features of the sill section 38.

Because of the greater width of the gateway 214, the sill section 216 is necessarily longer than the sill section 38. Moreover, unlike the sill section 38, the sill section 216 includes a flat and enlarged sill plate 224. The sill plate 224 is situated on a line bisecting the sill section 216, and is symmetrical about this line. The sill plate 224 joins the lower leg 222 at its free edge, extends in orthogonal relationship to the lower leg 222, and extends in spaced, parallel and opposed relationship to the upper leg 220. In one embodiment the sill plate 224 has the shape of a semicircle having a diameter that joins the aligned major side of a rectangle. The length of the major side and the diameter are equal.

A plurality of fastener openings 226, each preferably compact in shape, penetrate the sill plate 224. Preferably, the fastener openings 226 are distributed symmetrically about a line bisecting the sill plate 224. In the embodiment shown in the Figures, three such fastener openings 226 are formed. One fastener opening 226 is located on the bisecting line. Two other fastener openings 226 are situated on opposite sides of the same bisecting line.

In one embodiment, the sill section 216 is formed from A36 sheet steel having a thickness of 0.25 inches. The upper leg 220 is of rectangular shape with a major side dimension of 90.50 inches and a minor side dimension of 2.00 inches. The lower leg 222 has a maximum length of 96.00 inches and a maximum width of 1.81 inches. The sill plate 224 has a maximum length of 8 inches and a maximum width of 6 inches.

The gate assembly 202 further comprises a first swinging gate 228 and a second swinging gate 230, shown in FIGS. 35 and 36. The first swinging gate 228 is pivotally attached to the first upright section 208 by a plurality of hinges, and is positionable within a first region 232 of the gateway 214. The second swinging gate 230 is pivotally attached to the second upright section 210 by a plurality of hinges, and is positionable within a second region 234 of the gateway 214.

Figure 37:
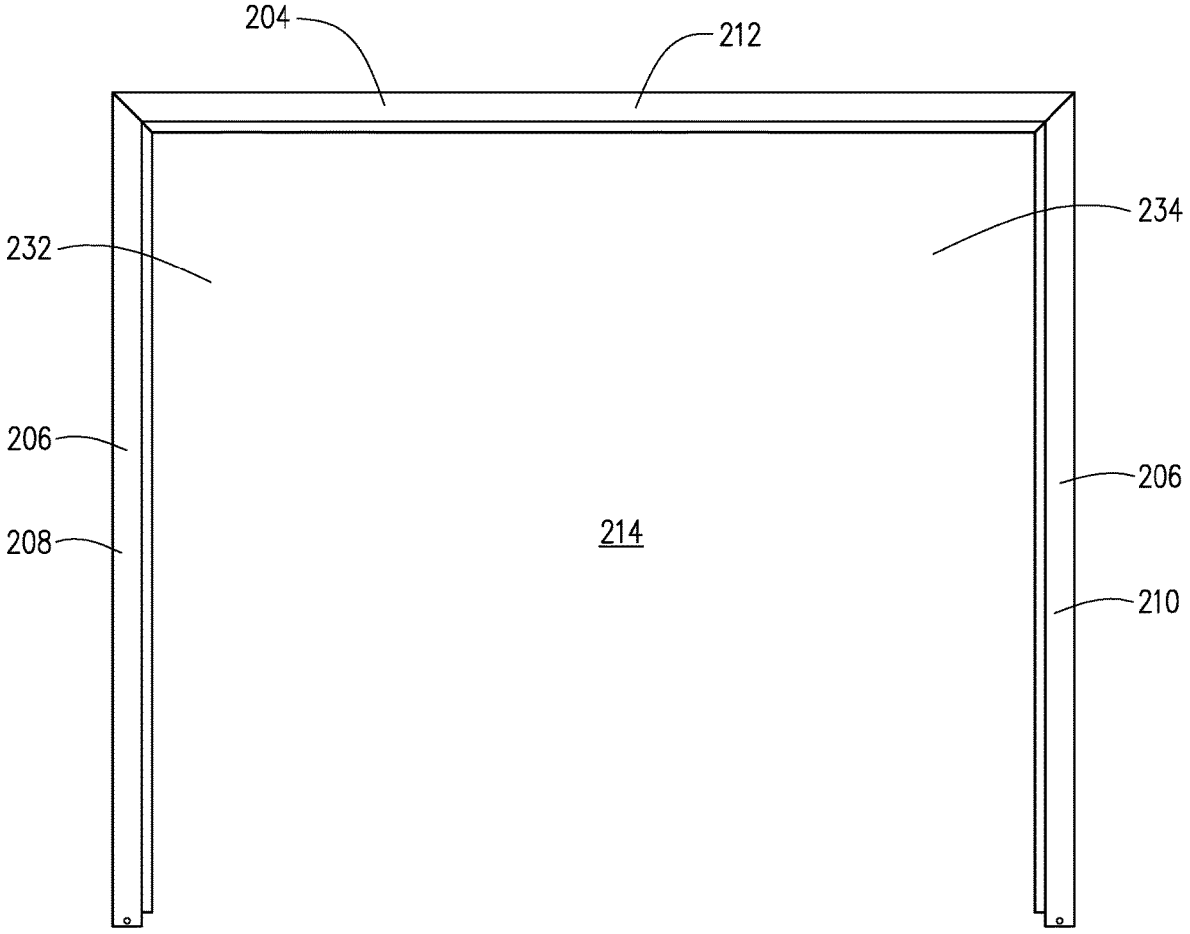
FIG. 37 is a front elevation view of a jamb.
Figure 39:
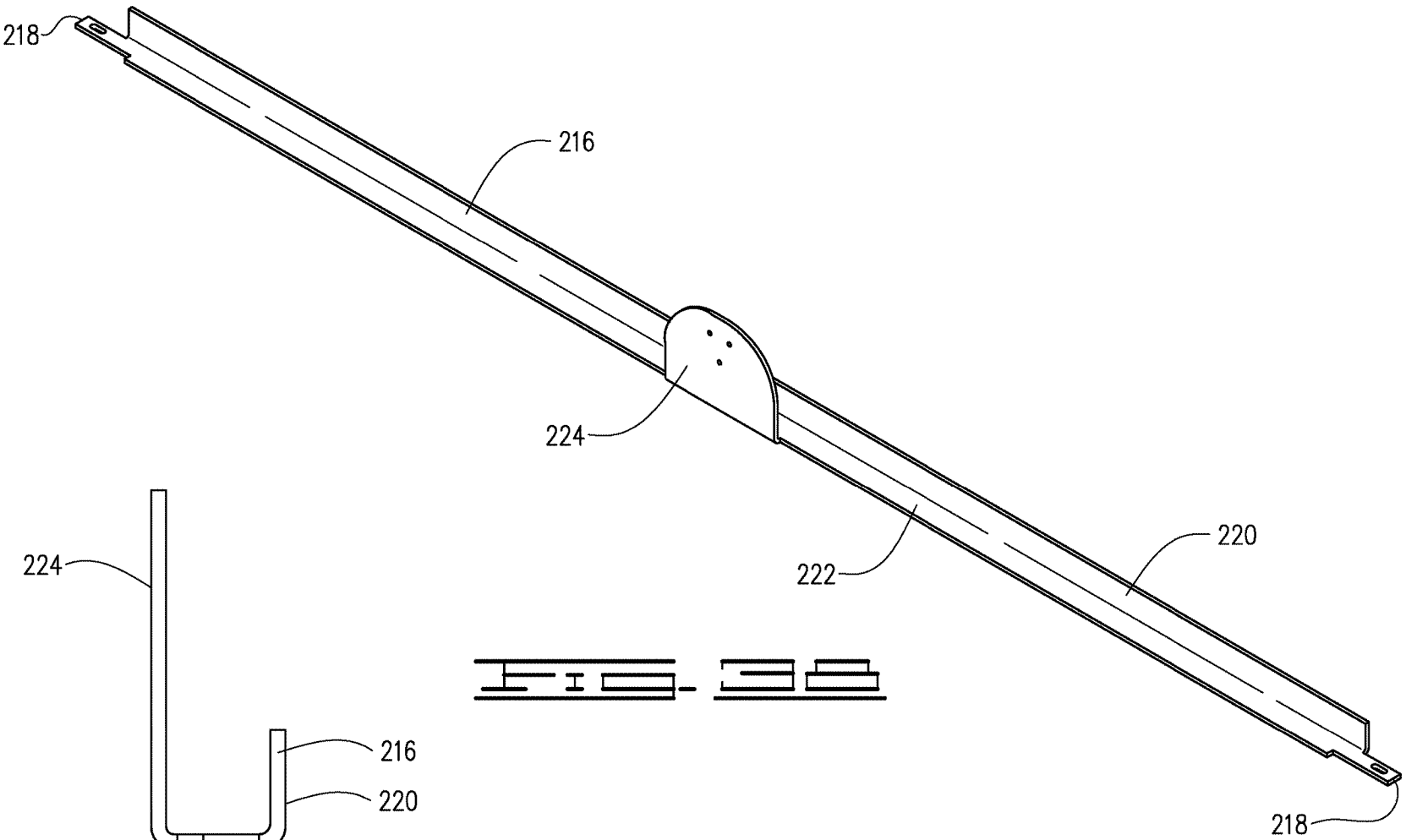
FIG. 39 is a front elevation view of the sill section shown in FIG. 38.
Figure 40:
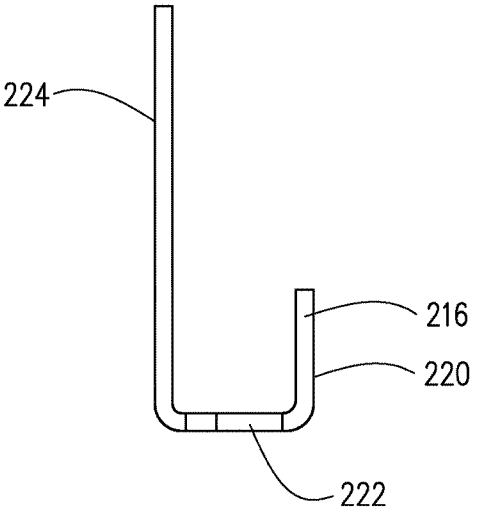
FIG. 40 is a side elevation view of the sill section shown in FIG. 39, taken along line 40-40.
Figure 39:
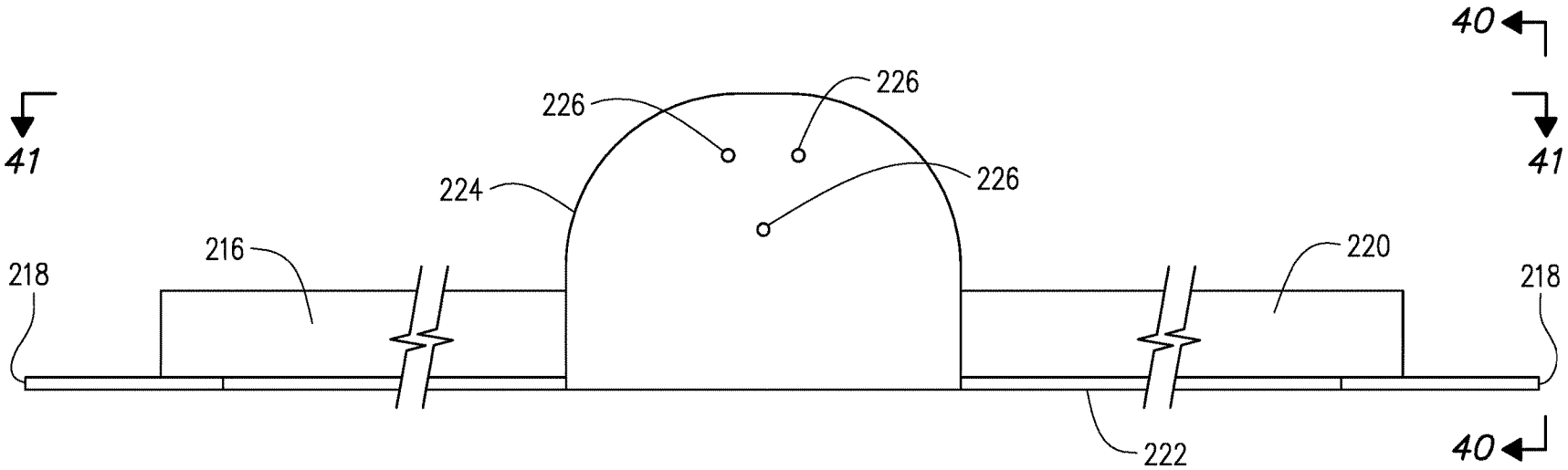
Figure 41:
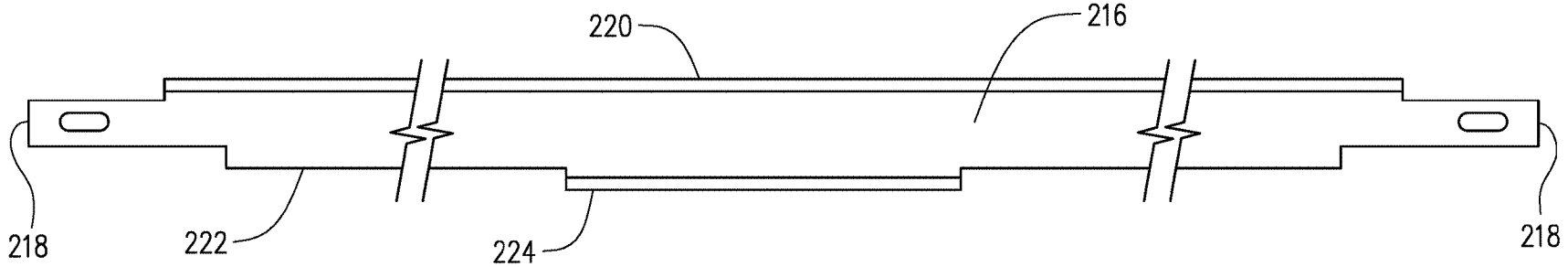
FIG. 41 is a top plan view of the sill section shown in FIG. 39, taken along line 41-41.

The first and second regions 232 and 234, shown in FIG. 37, are laterally offset from one another.

The first and second swinging gates 228 and 230 are mirror images of one another, with each having features, construction, components and accessories identical to those of the gate 14. Installation of the gates 228 and 230 within the jamb 204 is identical to that described with reference to the gate 14 and jamb 12.

Brackets 236, identical to the first and second brackets 160 and 162 of the gate assembly 10, are attached to the upright jamb sections 206. In lieu of brackets 236, the gate assembly 202 may incorporate any of the alternate structures described with reference to FIGS. 31-34. The brackets 236, and any alternate structure that replaces them, are used to install the gateway 202 within a barrier.

Figure 42:
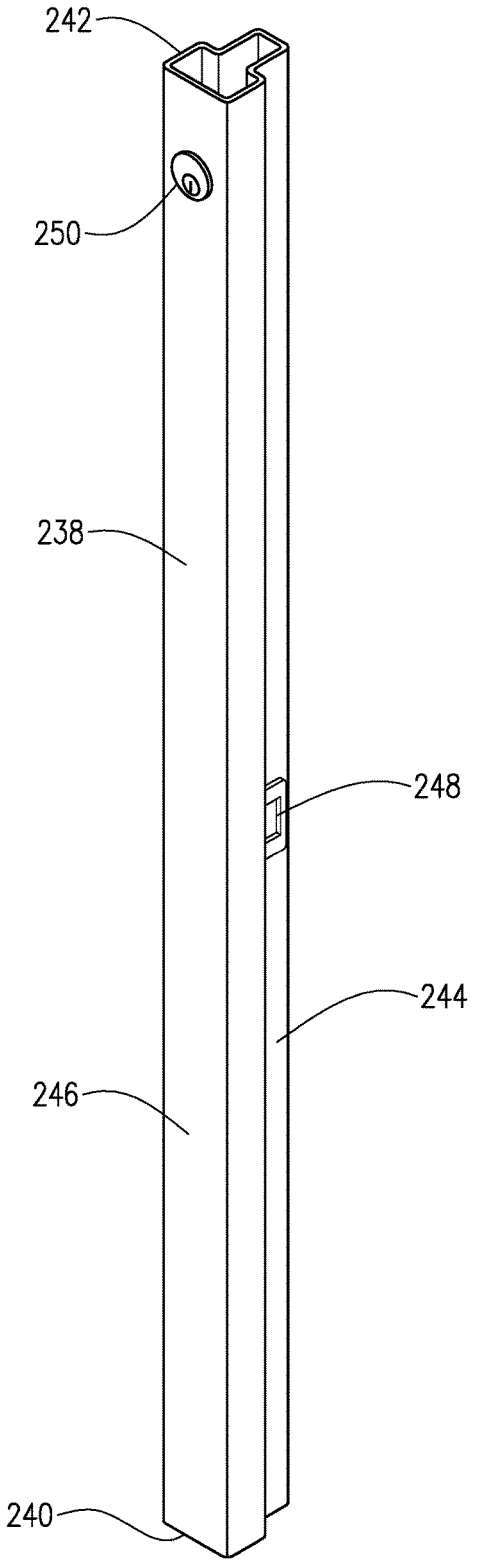
FIG. 42 is a perspective view of a mullion post.
Figure 43:
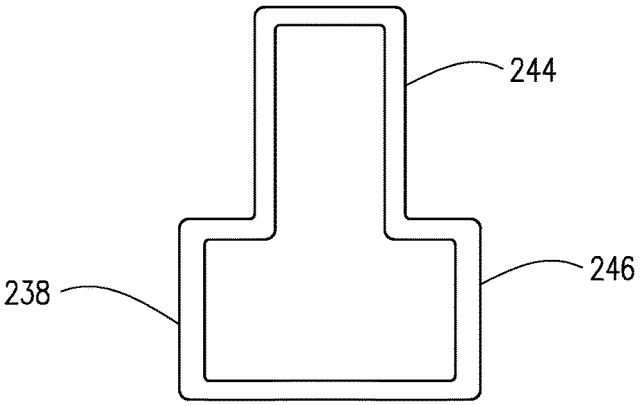
FIG. 43 is a top plan view of the mullion post shown in FIG. 42. The locking mechanism is not shown.

The gate assembly 202 further comprises a removable mullion post 238, shown in FIGS. 42 and 43. The mullion post 238 has opposed first and second ends 240 and 242, and is extendable between the header section 212 and the sill section 216. When installed within the jamb 204, as shown in FIGS. 35 and 36, the mullion post 238 divides the gateway into the first and second regions 232 and 234.

As shown in FIGS. 42 and 43, the mullion post 238 is preferably an elongate hollow structure having a T-shaped cross-section. An elongate stem section 244 joins a medial portion of an elongate and orthogonal base section 246. A strike plate 248 is installed on each side of the stem section 244, at a medial portion thereof. Optionally, a locking mechanism 250 may be installed within the base section 246, preferably adjacent the second end 242.

Figure 44:
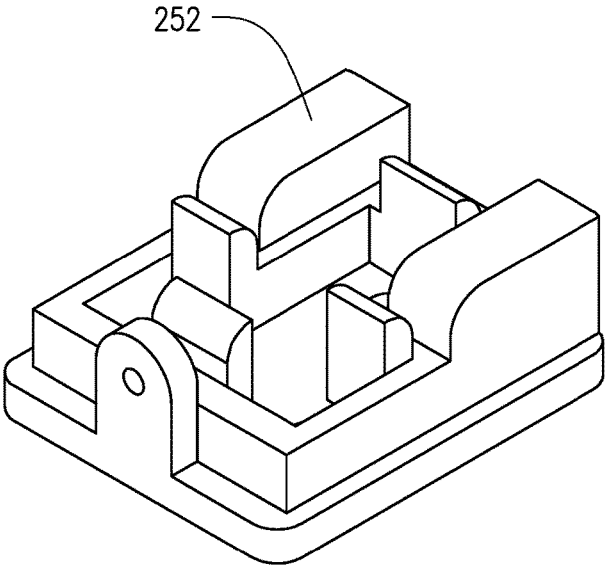
FIG. 44 is a perspective view of a lower mullion mounting block.
Figure 45:
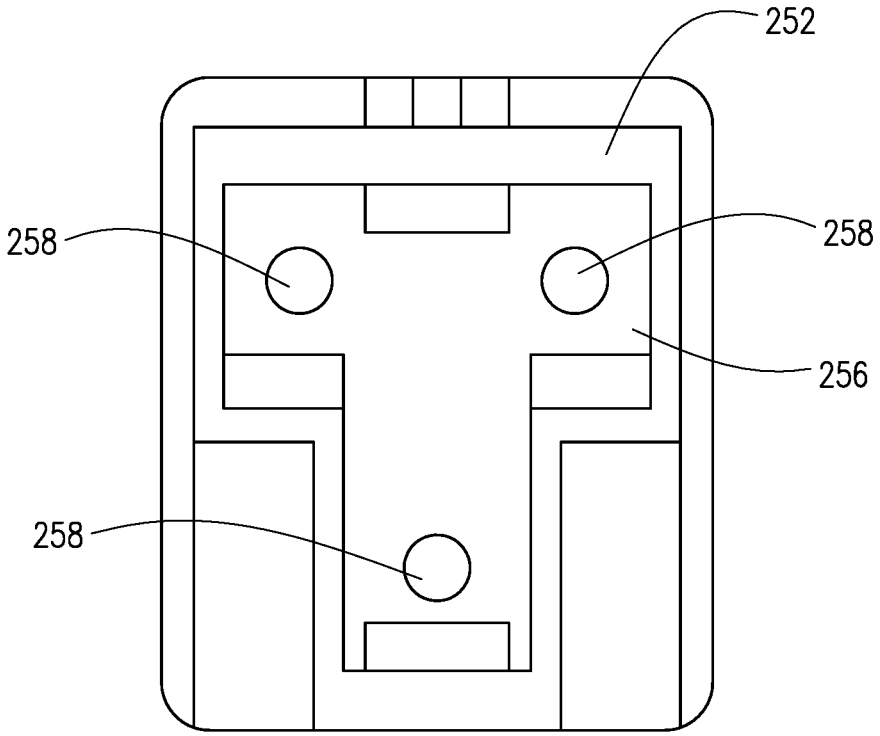
FIG. 45 is a top plan view of the lower mullion mounting block shown in FIG. 44.
Figure 46:
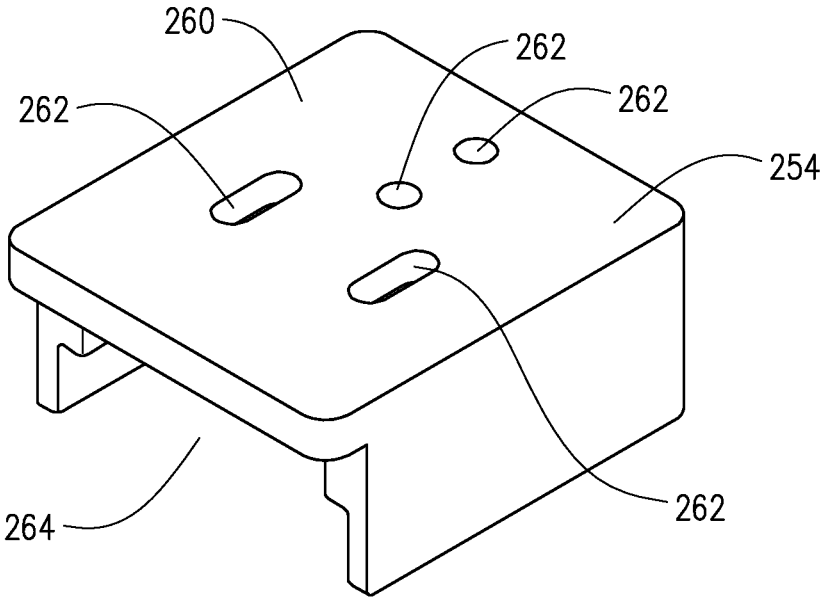
FIG. 46 is a perspective view of an upper mullion mounting block.
Figure 47:
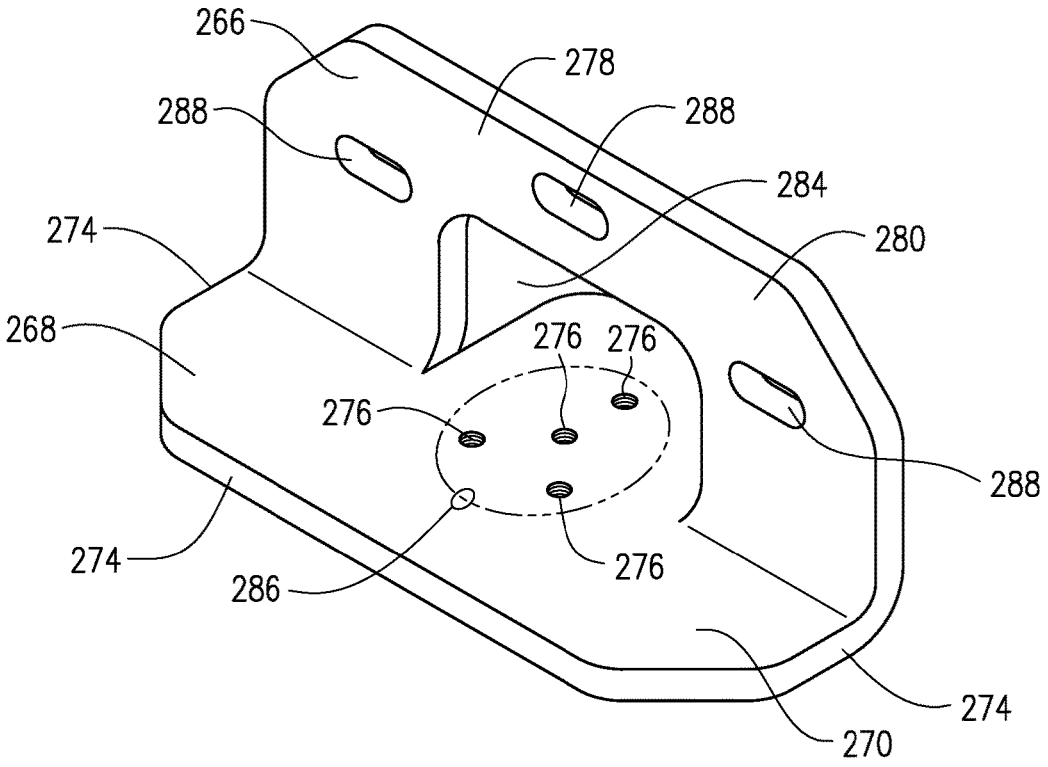
FIG. 47 is a perspective view of a mullion support bracket.
Figure 48:
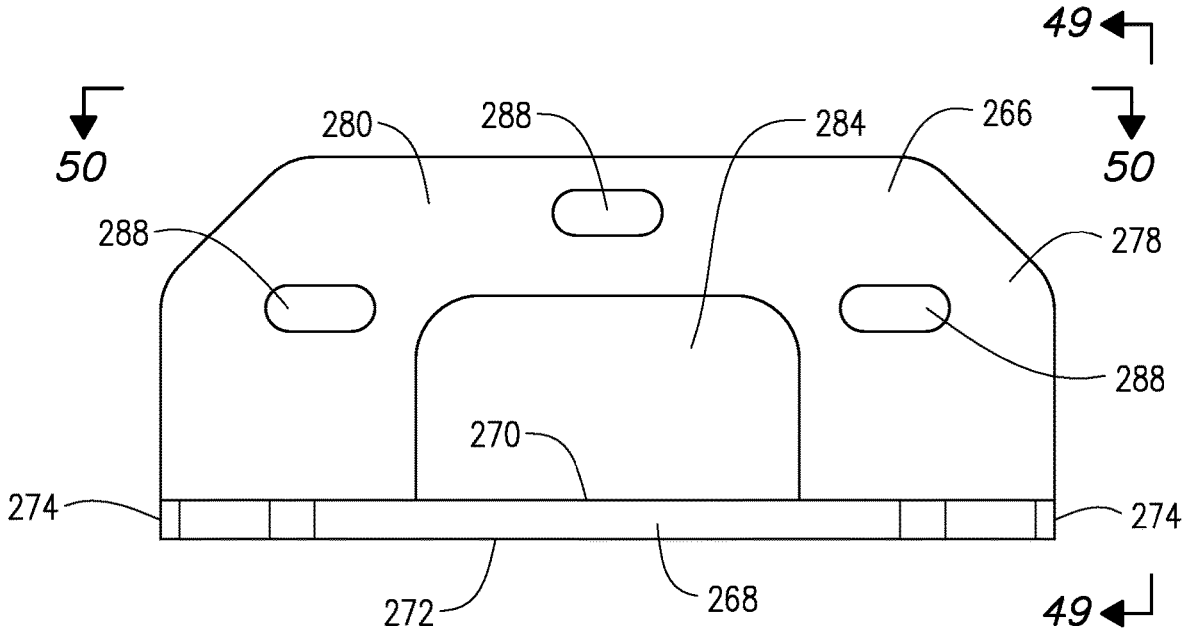
FIG. 48 is a front elevation view of the mullion support bracket shown in FIG. 47.
Figure 49:
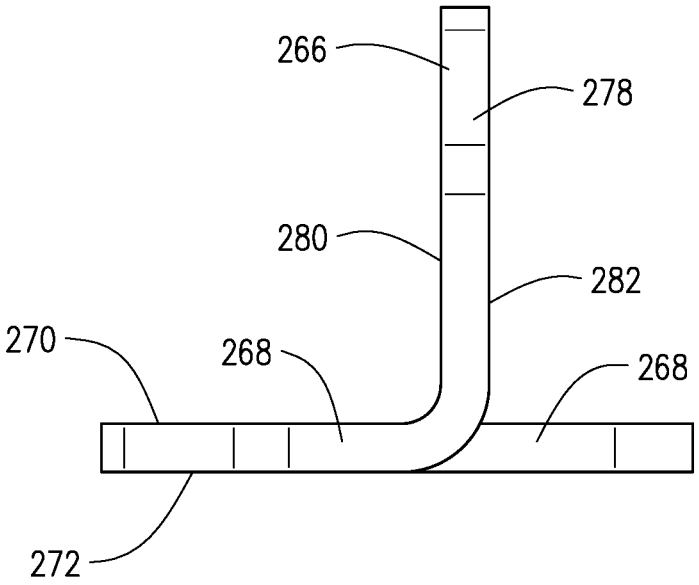
FIG. 49 is a side elevation view of the mullion support bracket shown in FIG. 48, taken along line 49-49.
Figure 50:
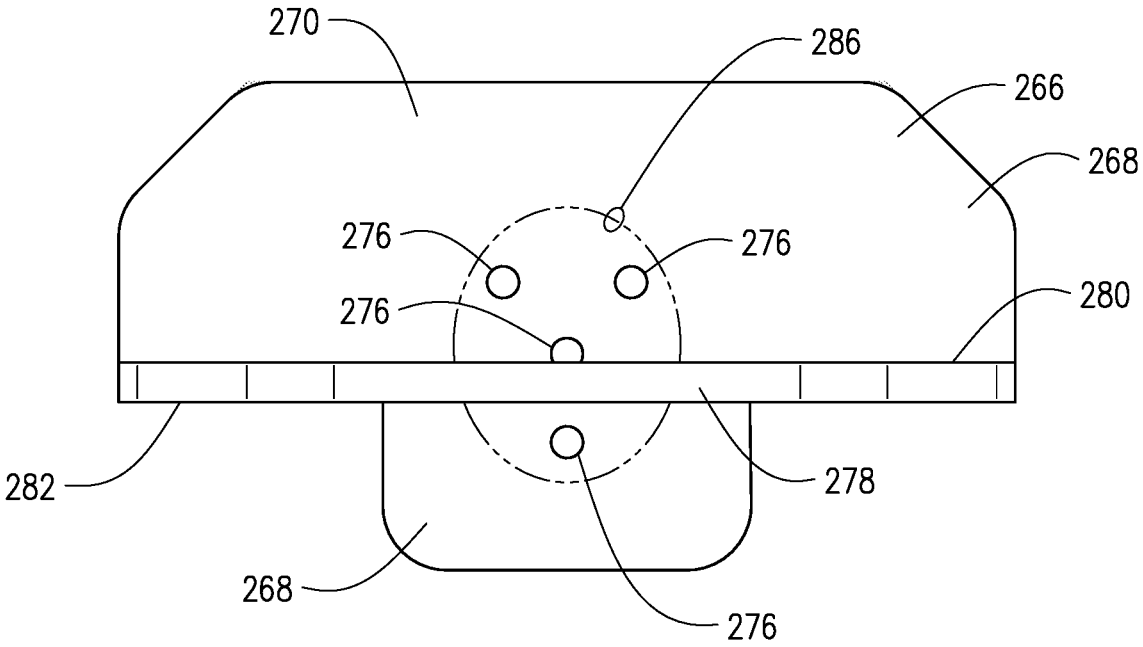
FIG. 50 is a top plan view of the mullion support bracket shown in FIG. 48, taken along line 50-50.

The gate assembly 202 further comprises a lower mullion mounting block 252, shown in FIGS. 44 and 45, and an upper mullion mounting block 254, shown in FIG. 46. The mounting blocks 252 and 254 cooperate to maintain the mullion post 238 within the gateway 214, at a fixed and medial position therein.

As shown in FIGS. 44 and 45, the lower mullion block 252 is a tray-like structure sized and shaped to closely receive the first end 240 of the mullion post 238. The lower mullion mounting block 252 includes a flat base 256, which is preferably rectangular in shape. A plurality of anchor openings 258, each preferably compact in shape, penetrate the lower mullion mounting block 252 at its base 256. The anchor openings 258 are preferably distributed symmetrically about a line bisecting the mounting block 252. The pattern of plural anchor openings 258 registers with the pattern of plural fastener openings 226 formed in the sill plate 224.

In the embodiment shown in the Figures, three such anchor openings 258 are formed. One anchor opening 258 is located on the bisecting line. Two other anchor openings 258 are situated on opposite sides of the same bisecting line.

Much like the lower mullion mounting block 252, the upper mullion mounting block 254 is a tray-like structure sized and shaped to closely receive the second end 242 of the mullion post 238. As shown in FIG. 46, the upper mullion mounting block 254 includes a flat base 260, which is preferably rectangular in shape. A plurality of fastener openings 262 penetrate the upper mullion mounting block 254 at its base 260. The fastener openings 262 are preferably distributed symmetrically about a line bisecting the mounting block 254.

In the embodiment shown in the Figures, four such fastener openings 262 are formed. Two fastener openings 262 are located on the bisecting line, and each is preferably compact in shape. Two other fastener openings 262 are situated on opposite sides of the same bisecting line, and each is preferably oblong in shape.

At one of its sides, the upper mullion mounting block 254 features an opening 264. The opening 264 permits the mullion post 238 to be rotated into an installed position between the mounting blocks 252 and 254. To install the mullion post 238, its first end 240 is first inserted into the mounting block 252. The mullion post 238 is then rotated about the first end 240 until the second end 242 enters the mounting block 254 through the opening 264. The locking mechanism 250 can then be actuated, in order to block unauthorized removal of the mullion post 238 from between the mounting blocks 252 and 254.

The gate assembly 202 further comprises a mullion support bracket 266, shown in FIGS. 47-50. The mullion support bracket 266 is preferably a unitary member formed from a single piece of material.

The mullion support bracket 266 comprises a flat base 268 having opposed first and second sides 270 and 272 and a plurality of edges 274. Preferably, the base 268 has a generally polygonal shape. In the embodiment shown in the Figures, the base 268 has the general shape of an irregular nonagon.

A plurality of fastener openings 276, each preferably compact in shape, penetrate the mullion support bracket 266 at the base 268. Preferably, the fastener openings 276 are distributed symmetrically about a line bisecting the base 268. In the embodiment shown in the Figures, four such fastener openings 276 are formed. Two fastener openings 276 are located on the bisecting line. Two other fastener openings 276 are situated on opposite sides of the same bisecting line. The pattern of plural fastener openings 276 registers with the pattern of plural fastener openings 262 formed in the upper mullion mounting block 254.

The mullion support bracket 266 further comprises a flat upright element 278 having opposed first and second sides 280 and 282. The upright element 278 joins the base 268 and extends in transverse, and preferably orthogonal, relationship thereto. Preferably, the upright element 278 has a generally polygonal shape. In the embodiment shown in the Figures, the upright element 278 has the general shape of a trapezoid.

The upright element 278 preferably interconnects a pair of non-adjoining edges 274 of the base 268. Preferably, the upright element 278 is positioned such that a portion of the base 268 is situated adjacent each of its sides 280 and 282. Likewise, at least one fastener opening 276 is situated adjacent each side 280 or 282 of the upright element 278.

A passageway 284 extends through the upright element 278, and is partially bounded by the base 268. An imaginary closed curve 286 can be inscribed on the base 268 such that it both surrounds the entirety of the fastener openings 276 formed in the base 268 and extends through the passageway 284.

A plurality of fastener openings 288, each preferably oblong in shape, penetrate the mullion support bracket 266 at the upright element 278. Preferably, the fastener openings 288 are distributed symmetrically about a line bisecting the upright element 278. In the embodiment shown in the Figures, three such fastener openings 288 are formed. One fastener opening 288 is located on the bisecting line. Two other fastener openings 288 are situated on opposite sides of the same bisecting line.

In one embodiment, the mullion support bracket 266 is formed from a stainless steel sheet having a thickness of 0.31 inches. The base 268 has a maximum length of 3.50 inches and a maximum width of 3.81 inches. The upright element 278 has a maximum height of 3.00 inches.

Preferably, the gates 228 and 230 are "prehung" on the jamb 204 at a manufacturing facility. The mullion support bracket 266 is installed on the header section 212 at a central position intermediate its ends, as shown in FIG. 36. The upright element 278 engages the side of the header section 212, above and outside of the gateway 214. The base 268 is partially situated within the gateway 214. Both the base 268 and the upright element 278 engage the header section 212. The mullion support bracket 266 is placed such that the pattern of fastener openings 288 registers with a pattern of fastener openings (not shown) formed in the header section 212. Fasteners (not shown), such as bolts, are inserted through the aligned openings and actuated to connect the mullion support bracket 266 to the header section 212.

The upper mullion mounting block 254 is installed by placing its flat base 260 against the flat second side 272 of the base 268 of the mullion support bracket 266. The block 254 should be positioned such that the patterns of the plural fastener openings 262 and 276 register. Fasteners (not shown), such as bolts, are inserted through the aligned openings and actuated to connect the upper mullion mounting block 254 to the mullion support bracket 266.

The lower mullion mounting block 252 is temporarily installed by placing its flat base 256 against the upper side of the flat sill plate 224. The block 252 should be positioned such that the pattern of the plural anchor openings 258 registers with the pattern of the fastener openings 226. Fasteners (not shown), such as bolts, are inserted through the aligned openings and actuated to temporarily connect the lower mullion mounting block 252 to the sill plate 224.

After the mounting blocks 252 and 254 are in place, the mullion post 238 is temporarily installed between them. The mullion post 238 is maintained between the blocks 252 and 254 either by the locking mechanism 250 or by some other restraint. The gate assembly 202 is now configured for storage or transport, including transport from a manufacturing facility to an installation site.

After a gate assembly 202 has been transported to the site of a barrier, its incorporation into that barrier proceeds initially with the same steps described with reference to the gate assembly 10. Thus, when the gate assembly 202 includes brackets 236, the jamb 204 is positioned within a gate opening bounded by a pair of gate posts. The second legs of the brackets 236 are brought into flush engagement with the flat and coplanar surfaces of the gate posts. Fastener openings in the gate posts and brackets 236 are aligned, and fasteners installed and actuated within the aligned openings.

Once the jamb 204 has been mounted within the barrier, installation of the gate assembly 202 proceeds with these additional steps. The mullion post 238 is unlocked and temporarily removed from between the mounting blocks 252 and 254. The lower mullion mounting block 252 is next unfastened and removed from the sill plate 224, and the sill section 216 removed. The lower mullion block 252 is then placed on the surface 290 underlying the gateway 214, and the mullion post 238 reinstalled between the mounting blocks 252 and 254.

Figure 51:
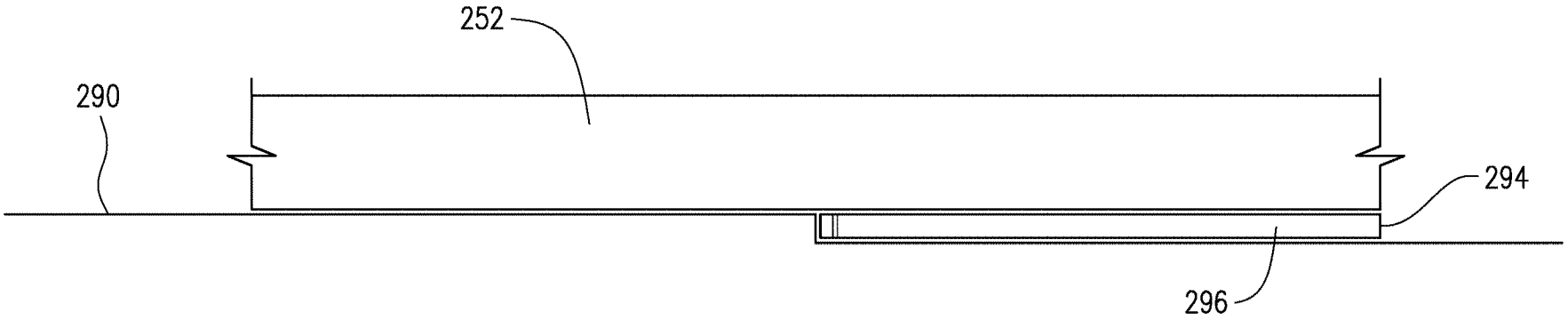
FIG. 51 is front elevation view of a portion of a lower mullion mounting block situated on a supporting surface. A shim has been installed between the surface and the lower mullion mounting block.

In order for the locking mechanism 292 on each of the gates 228 and 230 to function, that mechanism must operatively engage a corresponding strike plate 248 on the mullion post 238. Achieving this positioning may require vertical adjustment of the lower mullion mounting block 252. One or more leveling shims 294, to be described hereafter, may be interposed between the surface 290 and the block 252 to produce the desired vertical positioning, as shown in FIG. 51.

Once any necessary adjustments have been made to the position of the block 252, that position is preferably marked on the surface 290, such as by outlining the profile of the block 252 with a pencil or other marker. The mullion post 238 is removed, and the block 252 is used as a stencil template to locate where anchoring elements will be installed in the surface 290. These locations underlie the anchor openings 258, and are designated on the surface 290 with a pencil or other marker.

Alternately, the locations for anchoring elements may be designated using the sill plate 224, before removal of the sill section 216. These locations underlie the fastener openings 226, so that the sill plate 224 may be used as a stencil or template. Locations are designated on the surface 290 with a pencil or other marker.

The lower mullion mounting block 252 and any shims 294 are temporarily removed, and holes are drilled in the surface 290, using the markings previously placed on it for guidance. The shims 294 and block 252 are then restored to their previous positions, again using the markings on the surface 290 for guidance. Fasteners (not shown), such as anchor bolts, are inserted through the anchor openings 258, and actuated to secure the block 252 to the surface 290. The mullion post 238 is then reinstalled between the blocks 252 and 254, and locked into place.

Figure 53:
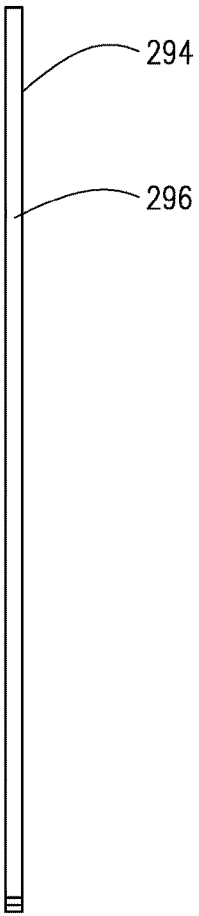
FIG. 53 is a side elevation view of the shim shown in FIG. 52, taken along line 53-53.
Figure 52:
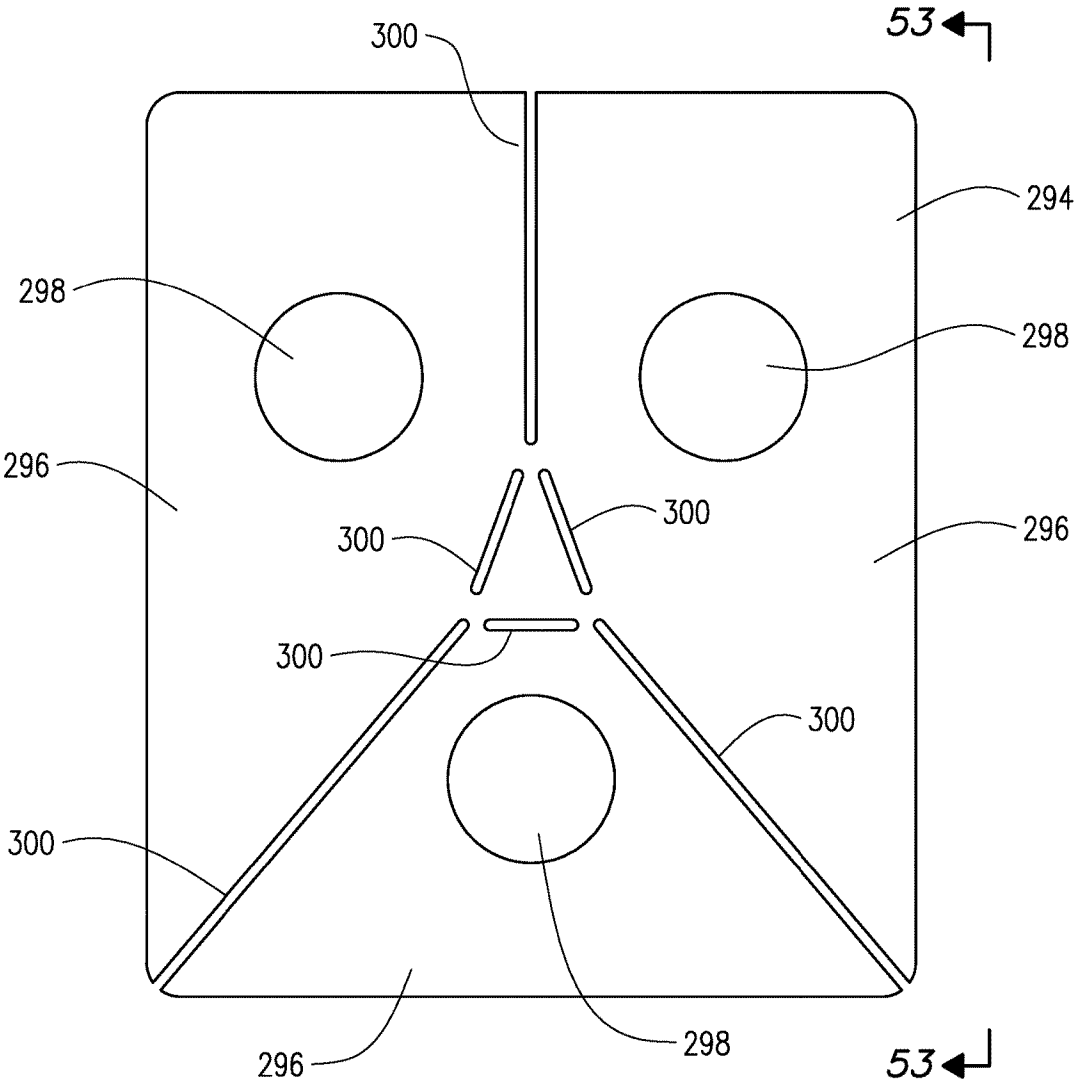
FIG. 52 is a front elevation view of a shim.

The gate assembly 202 further comprises a plurality of leveling shims 294, one of which is shown in FIGS. 52 and 53. The shim 294 is a thin and flat structure, preferably formed from a strong and durable material, such as stainless steel. The shape and dimensions of the shim 294 are preferably substantially the same as those of the base 256 of the lower mullion mounting block 252. In one embodiment, the shim 294 has a thickness of 0.06 inches, and a rectangular shape with a major side of 3.38 inches and a minor side of 2.88 inches.

The shim 294 comprises a plurality of tear-away tabs 296, preferably in a number that equals the number of anchor openings 258 in the lower mullion mounting block 252. An anchor opening 298 is formed in each tab 296. The pattern of the plural anchor openings 298 in the untorn shim 294 preferably registers with the pattern of plural anchor openings 258 in the lower mullion mounting block 252. Thus, when an untorn shim 294 is positioned underneath the lower mullion mounting block 252, an anchoring element that passes through an anchor opening 258 will also pass through a registering anchor opening 298 in the shim 294.

Each tab 296 within a shim 294 shares at least one boundary with another tab 296 of the plurality. When a shim 294 includes three tabs 296, each tab 296 shares a boundary with each other tab 296 of the plurality. In order to facilitate manual removal of each tab 296 from a shim 294, a plurality of scores 300 are formed at the boundaries of each tab 296.

When the mounting block 252 requires uniform elevation, no tabs 296 are removed from the shim or shims 294 that are placed underneath the block 252. In some instances, however, such as when the surface 290 is not flat, uniform elevation of the block may be undesirable. When elevation is required for only a portion of the block 252, one or more tabs 296 are removed from the shim or shims 294. As a result of such tab removal, the shim 294 extends only under that portion of the block 252 requiring elevation. A shim 294 having two removed tabs 296 is shown in FIG. 51.

Unless otherwise stated herein, any of the various parts, elements, steps and procedures that have been described should be regarded as optional, rather than as essential. Changes may be made in the construction, operation and arrangement of the various parts, elements, steps and procedures described herein without departing from the spirit and scope of the invention as described in the following claims.

The invention claimed is:

1. A gate assembly, comprising:

a jamb formed from a plurality of sections that cooperate to define boundaries of a gateway, the sections comprising:

an elongate first upright section, comprising:

an input portal;

an output portal; and an unobstructed internal channel interconnecting the input and output portals;

an elongate second upright section extending parallel to the first upright section;

a header section interconnecting the first and second upright sections; and a swinging gate pivotally attached to the first upright section and positionable within the gateway, the gate having parallel and opposed front and rear sides that are interconnected by an elongate and upright surface, the surface having a recess formed therein;

a cable extending through the input and output portals, and within the internal channel; and a lead cover, comprising:

a frame received within the recess; and a tubular shell supported within the frame and having opposed ends;

in which the cable extends from the output portal into the lead cover and passes from end to end within the shell.

2. The assembly of claim 1 in which the output portal is formed in a portion of the first upright section that faces the gateway.

3. The assembly of claim 2 in which the input portal is formed in a portion of the first upright section that does not face the gateway.

4. A system, comprising:

a barrier installed on an outdoor terrain and having a gate opening formed therein; and the gate assembly of claim 1, positioned within the gate opening of the barrier.

5. The assembly of claim 1 in which each of the first and second upright sections supports a projecting leg that extends away from the gateway.

6. The assembly of claim 1 in which the jamb further comprises:

a removable sill section that interconnects the first and second upright sections and forms another boundary of the gateway.

7. The assembly of claim 1 in which a plurality of bolt openings are formed in a portion of the header section situated opposite the gateway, and further comprising:

a plurality of eye bolts, each eye bolt removably received in a respective bolt opening.

8. The assembly of claim 1 in which the gate is characterized by opposed sides and at least one window opening that interconnects the sides, and in which the gate further comprises:

at least one modular window panel, each window panel removably installed within a respective window opening.

9. The assembly of claim 1 in which the header section has a plurality of bolt openings formed in a portion thereof situated opposite the gateway.

10. The assembly of claim 9, further comprising:

a plurality of eye bolts, each eye bolt removably received in a respective bolt opening.

11. A system, comprising:

a barrier installed on an outdoor terrain and having a gate opening formed therein; and the gate assembly of claim 9, positioned within the gate opening of the barrier.

12. The gate assembly of claim 1 in which the frame has a shape characterized by a pair of spaced and opposed faces, and in which the cable passes through both faces.

13. The assembly of claim 10 in which each eye bolt is a unitary structure that terminates within the header section.

* * * * *